US005823525A

United States Patent [19]

Miki

[11] Patent Number: 5,823,525

[45] Date of Patent: Oct. 20, 1998

[54] METHODS OF AND SYSTEMS FOR ADJUSTABLY FEEDING IMAGE-CARRYING MEDIA OF VARIOUS SIZES

[75] Inventor: Katsuhiko Miki, Kawasaki, Japan

[73] Assignee: Ricoh Company Ltd., Japan

[21] Appl. No.: 681,213

[22] Filed: Jul. 22, 1996

[30] Foreign Application Priority Data

Jul. 21, 1995 [JP] Japan ..... 7-185523

[51] Int. Cl.[6] ..... B65H 1/08

[52] U.S. Cl. ..... 271/127; 271/160; 271/164; 271/171

[58] Field of Search ..... 399/393; 271/126, 271/127, 160, 162, 164, 171, 9.06

[56] References Cited

U.S. PATENT DOCUMENTS

| | | | |
|---|---|---|---|
| 4,623,137 | 11/1986 | Irie et al. | 271/160 |
| 4,940,222 | 7/1990 | Maeno et al. | 271/127 |
| 5,005,820 | 4/1991 | Leemhius | 271/160 |

FOREIGN PATENT DOCUMENTS

| | | | |
|---|---|---|---|
| 0084735 | 6/1980 | Japan | 271/160 |
| 0131642 | 8/1982 | Japan | 271/171 |
| 58-81536 | 6/1983 | Japan . | |
| 0291324 | 12/1990 | Japan | 271/160 |
| 404 313 523 A | 11/1992 | Japan | 271/171 |
| 406016254 A | 1/1994 | Japan | 271/160 |

*Primary Examiner*—H. Grant Skaggs
*Attorney, Agent, or Firm*—Knoble & Yoshida LLC

[57] ABSTRACT

The current invention generally discloses methods, devices and systems for feeding an image-carrying medium of various sizes to an image-generating machine and more particularly discloses the methods, devices and system of applying a desirable initial pressure to a pile of an image-carrying medium towards a predetermined direction according to the medium size and the initial stack size and of continuously decreasing the pressure as the stack size is reduced.

36 Claims, 18 Drawing Sheets

METHODS OF AND SYSTEMS FOR ADJUSTABLY FEEDING IMAGE-CARRYING MEDIA OF VARIOUS SIZES

FIELD OF THE INVENTION

The current invention is generally related to an image-carrying medium feeding device, and more particularly related to an universal tray for feeding various sizes of the image-carrying media at a desirable pressure.

BACKGROUND OF THE INVENTION

Image-generating machines such printers, copiers and facsimiles each include an image-recording unit and an image-carrying medium supplying unit for supplying the image-carrying medium such as paper and plastic transparency to the image-recording unit. The image-carrying medium supplying unit or more commonly known as a paper supply tray generally holds the image-carrying medium of a predetermined size. A pile of the image-carrying medium is placed on a movable bed in the tray unit, and the bottom of the bed is urged towards a predetermined feeding position where a sheet of the image-carrying medium is taken by a feeding roller. In order to take one sheet from the pile of the image-carrying medium, the friction force between the feeding roller and a top sheet contacting the feeding roller is larger than the friction force between the top sheet and the next sheet placed below the top sheet. However, in order to have the above described desirable frictional force, the pressure applied to the pile of the image-carrying medium via the bed must be precisely controlled.

The above described desirable pressure applied to the image-carrying medium depends upon a number of factors. When the feeding roller feeds the first sheet, the desirable pressure should be determined based upon the initial number of sheets on the bed, the size of the image-carrying medium as well as the weight density and the frictional characteristic of each sheet of the image carrying medium. With the weight density and the friction characteristics being equal, the initial desirable pressure should be determined based upon the number of sheets and the size of the image-carrying medium at the start of the feeding operation. As the feeding operation continues, the sheets are fed from the initially loaded pile of the image-carrying medium. As the pile size decreases, the initial pressure should be also accordingly deceased in a continuous manner. Without the above described proper pressure, the image-carrying medium is not supplied to the image-recording unit in a consistent and reliable manner.

In order to satisfy the above described requirements, one approach in prior attempts includes a motorized image-carrying supplying unit. To provide a constant pressure on a pile of the image-carrying medium, the bed is moved by a motorized structure towards a feeding roller. However, this type of a supplying unit is generally expensive to manufacture and requires a difficult repair work. Another approach in the prior attempts includes certain structures in a paper tray to restrict the paper size or the paper capacity. For example, the maximal storage capacity of the paper tray is reduced to a predetermined weight as disclosed in Japanese Utility Model 58-81536. Another example of the restriction is that one paper tray is designed to accept only one predetermined size of the image-carrying medium. The above described first restriction requires a more frequent replenishing of the image-carrying medium due to a smaller capacity. The second restriction requires multiple trays to accommodate various sizes of the image-carrying media.

According to another approach, a different amount of pressure is applied to facilitate the feeding process. Japanese Utility Model 58-81536 also discloses a paper tray which allows a user to adjust the spring pressure applied to the bed. Referring to FIG. 1, an image-carrying medium 124 is placed on a movable bed 128 located in a tray 120. The image-carrying medium 124 is urged by a spring 130 via the movable bed 128 in an upward direction towards a feeding roller 126. This utility model application also discloses that the spring pressure is adjustable by turning a spring adjustable screw 132 located at one end of the spring. However, the disclosure is completely silent as to the utility or purpose of this adjustment. The above described prior attempt requires the user to turn the spring adjustment screw at the bottom of the tray.

The above described image-carrying supplying units in the prior attempts cannot easily modify a desirable pressure according to the size as well as the decreasing load of the image-carrying medium during the feeding process.

SUMMARY OF THE INVENTION

In order to solve the above and other problems, according to one aspect of the current invention, a method of lifting an image-carrying medium towards a predetermined location in an image-carrying medium supplying unit, the supplying unit having a movable guide for holding a predetermined capacity of the image-carrying medium and any size of the image-carrying medium within a predetermined range, includes the steps of: a) placing a stack of the image-carrying medium in the supplying unit; b) moving the guide to fit a size of the image-carrying medium placed in the supplying unit, the size being continuously variable; and c) applying a desirable initial pressure on the image-carrying medium in proportion to the size indicated by the guide towards the predetermined location, the desirable initial pressure continuously decreasing to a predetermined final pressure as the stack is reduced until a last sheet of the image-carrying medium reaches the predetermined location.

According to a second aspect of the current invention, a method of lifting image-carrying media in an image-carrying medium supplying tray, includes the steps of: a) applying a desirable pressure on a pile of the image-carrying medium placed in the image-carrying medium supplying tray based upon a size of the pile; b) reducing the pile of the image-carrying medium; c) continuously decreasing the pressure as the pile is reduced; and d) releasing the pressure while replenishing the stack of the image-carrying medium in the image-carrying medium supplying tray.

According to a third aspect of the current invention, an image-carrying medium supplying device, includes a movable image-carrying medium holding unit for holding a stack of an image-carrying medium; a size indicator located on said moveable image-carrying medium holding unit for indicating a size of the image-carrying medium held in the image-carrying medium holding unit, the size being continuously variable within a predetermined range; and an urging unit connected to the size indicator and the image-carrying medium holding unit for urging the image-carrying medium holding unit in a predetermined direction with a desirable pressure in proportion to the indicated size.

According to a fourth aspect of the current invention, an universal image-carrying medium supplying tray, includes: a movable image-carrying medium holding unit for holding up to a predetermined maximum number of sheets of an image-carrying medium of various sizes; an adjustable side fence located on the image-carrying medium holding unit for guiding the image-carrying medium held in the image-carrying medium holding unit, a position of the side fence determining a size of the image-carrying medium; a link device having at least one link bar, one end of the link bar being connected to the adjustable side fence for conveying the position indicative of the size of the image-carrying medium; and a plurality of springs of a different strength, one end of at least one of the springs being connected to the other end of the link bar for being expanded to a length determined by the position of the link bar, the other end of the spring being connected to image-carrying medium holding unit so as to urge the image-carrying medium holding unit in a predetermined direction with a desirable initial pressure based upon in part the size of the image carrying medium.

According to a fifth aspect of the current invention, a system for supplying an image-carrying medium to an image-generating machine which includes an image-synthesis engine for generating an image on an image-carrying medium and a feeding roller for feeding a sheet of the image-carrying medium towards the image-synthesis engine, includes: a tray unit detachably located in the image-generating machine near the feeding roller; a movable holding unit located on the tray unit for holding a stack of the image-carrying medium of size within a predetermined range, the holding unit being movable towards the feeding roller; a size indicator located on the movable holding unit for indicating a size of the image-carrying medium held in the holding unit, the size being continuously variable within the predetermined range; and an adjustable urging unit connected to the size indicator and the holding unit for urging the holding unit towards the feeding roller with a desirable initial pressure in proportion to the indicated size, the urging unit adjustably decreasing the initial pressure to a predetermined final pressure as the feeder reduces the stack on the holding unit.

According to a sixth aspect of the current invention, a system for generating an image on an image-carrying medium, includes an image-generating machine having an image-synthesis engine and a feeding roller for feeding a sheet of an image-carrying medium towards the image-synthesis engine; an image-carrying medium supplying unit located near the feeding roller for holding a stack of the image-carrying medium, the image-carrying medium supplying unit being adjustable to hold various sizes of the image-carrying medium; a pressure applying unit located near the image-carrying medium supplying unit for applying a desirable pressure to the stack of the image-carrying medium towards the feeding roller; and a control unit connected to the pressure applying unit for controlling the desirable pressure in proportion to a size and an amount of the image-carrying medium held in the image-carrying medium supplying unit.

According to a seventh aspect of the current invention, a system for supplying an image-carrying medium of various sizes to an image-generating machine having an image-synthesis engine and a feeding roller for feeding a sheet of an image-carrying medium towards the image-synthesis engine, includes: a plurality of image-carrying medium storing trays located in the image-generating machine for each storing a predetermined size of the image-carrying medium; a feeding unit located near the feeding roller for holding a stack of the image-carrying medium of a selected size, the feeding unit being adjustable to hold various sizes of the image-carrying medium; a transferring unit located near the storing trays and the feeding unit for transferring the selected size of the image-carrying medium from one of the storing trays to the feeding unit; and a pressure applying unit located near the feeding unit for applying a desirable pressure to the selected stack towards the feeding roller based upon the selected size.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
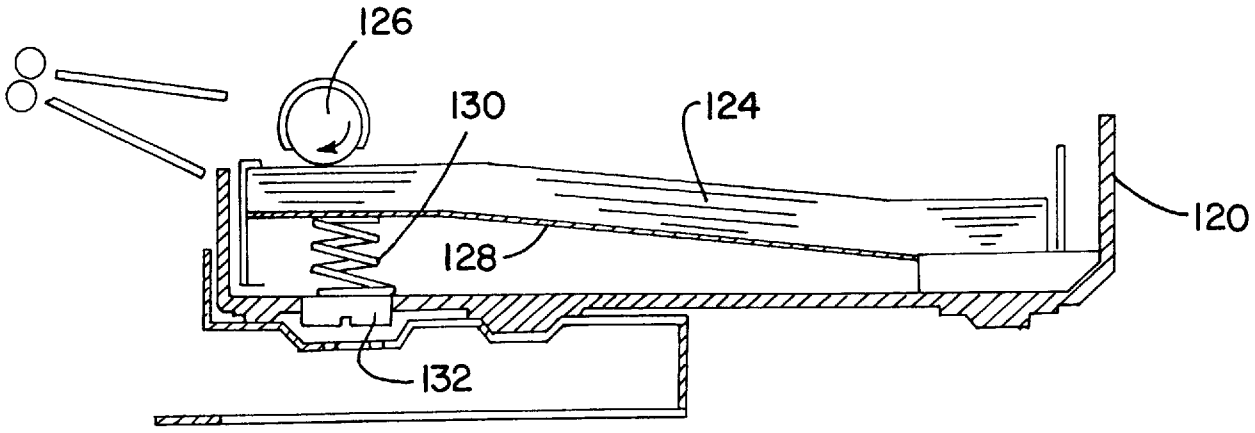
FIG. 1 illustrates a cross sectional view of a prior art image-carrying medium supplying unit.
Figure 2:
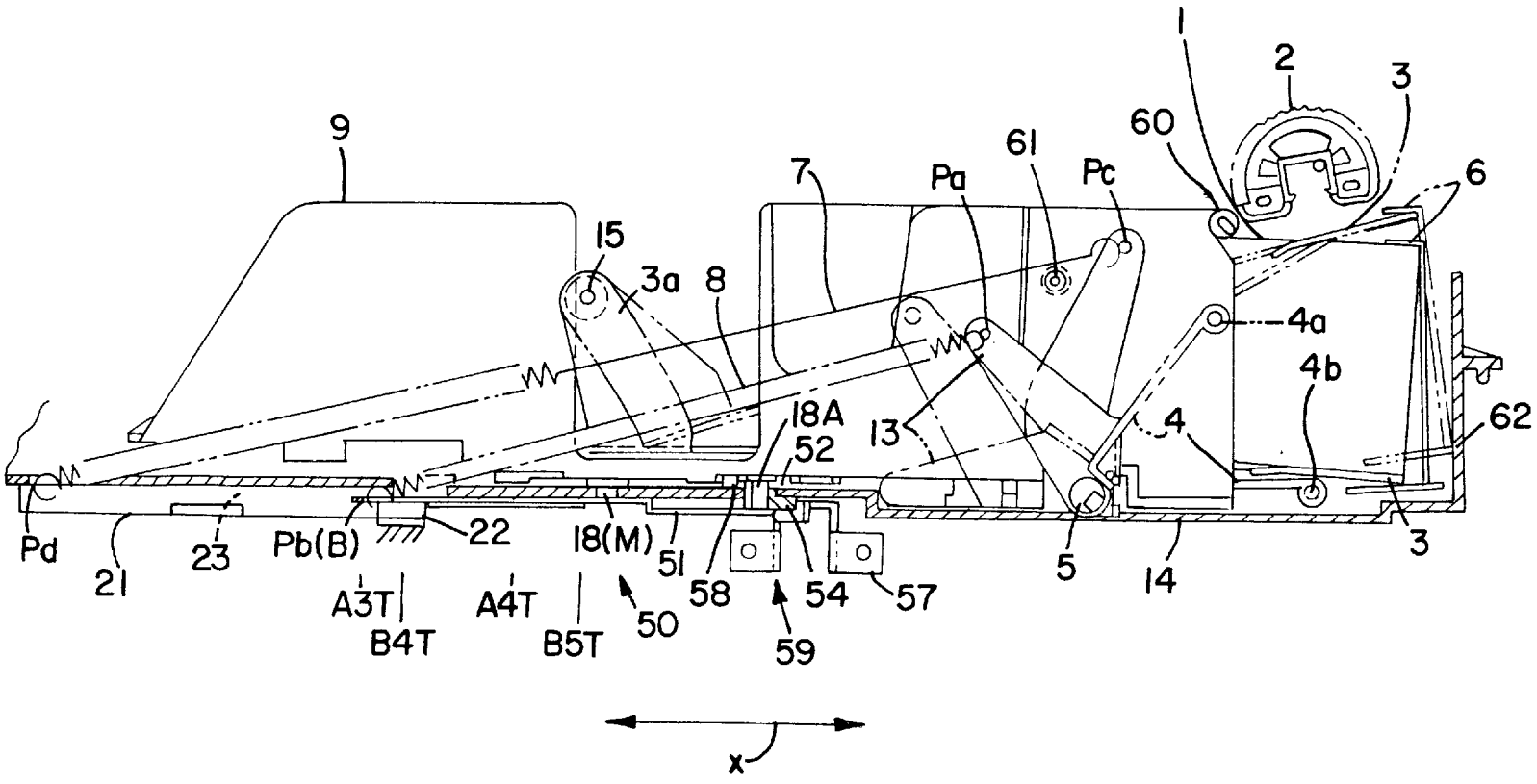
FIG. 2 is a cross sectional view of one preferred embodiment of the image-carrying medium supplying unit according to the current invention.

Referring now to the drawings, wherein like reference numerals designate corresponding structure throughout the views, and referring in particular to FIG. 2, a cross sectional view of a preferred embodiment of the image-carrying medium supplying unit or a universal paper tray 14 is illustrated according to the current invention. In general, the tray 14 is detached from an image-generating machine for loading a stack of an image-carrying medium on a holding bed plate 3 and between a pair of side fences 9. One example of the capacity of the preferred embodiment is 500 sheets of paper in a commonly-used size. When the tray 14 is detachably inserted or mounted inside the image-generating machine, one end of the tray 14 is located near a feeding roller 2 as shown in FIG. 2. This end proximal to the feeding roller is defined as a feeding side while a distal end is defined as a tail side. At the mounted position, the feeding side of the bed 3 is urged upwardly towards the feeding roller 2 so that a top sheet of the image-carrying medium contacts the feeding roller 2. The above described upward force is provided by two springs 7 and 8 via a spring connecting plate 13 and a pressing bar 4.

Still referring to FIG. 2, the holding bed travels in a substantially vertical direction at the feeding side. When a full load of the image-carrying medium as indicated in solid lines is loaded on the holding bed 3, the bed 3 is pressed downwardly towards the bottom of the tray 14 by the weight of the fully loaded image-carrying medium as shown in the solid line. As the sheets of the image-carrying medium are rolled away by the feeding roller 2 into the image-generating machine and the bed 3 is near empty, the feeding side of the bed 3 is pushed upwardly by the pressing bar 4 so that it reaches a position closer to the feeding roller 2 as indicated by double dotted lines. Upon receiving the force on the feeding side, the feeding side of the holding bed 3 moves along the guide 6 while the tail end of the bed 3 is pivoted by a bed pivot arm 3 at an axis 15. Because of the pivot at 15, as the bed 3 moves closer to the feeding roller 2, the bed is no longer substantially parallel to the tray 14 as it was when the image-carrying medium was fully loaded. As the bed 3 moves upwardly, the spring connecting plate 13 also rotates in a counterclockwise direction around a second axis 5 so that the springs are released to exert less force against the bed 3 via the connecting plate 13 and the bar 4. In other words, the amount of force against the bed 3 is adjusted as the pile of the image-carrying medium is decreased. Because of this adjustment, the pressure against the feeding roller 2 by the top sheet of the image-carrying medium is maintained at a substantially constant level throughout the operation regardless of the pile size.

Figure 3:
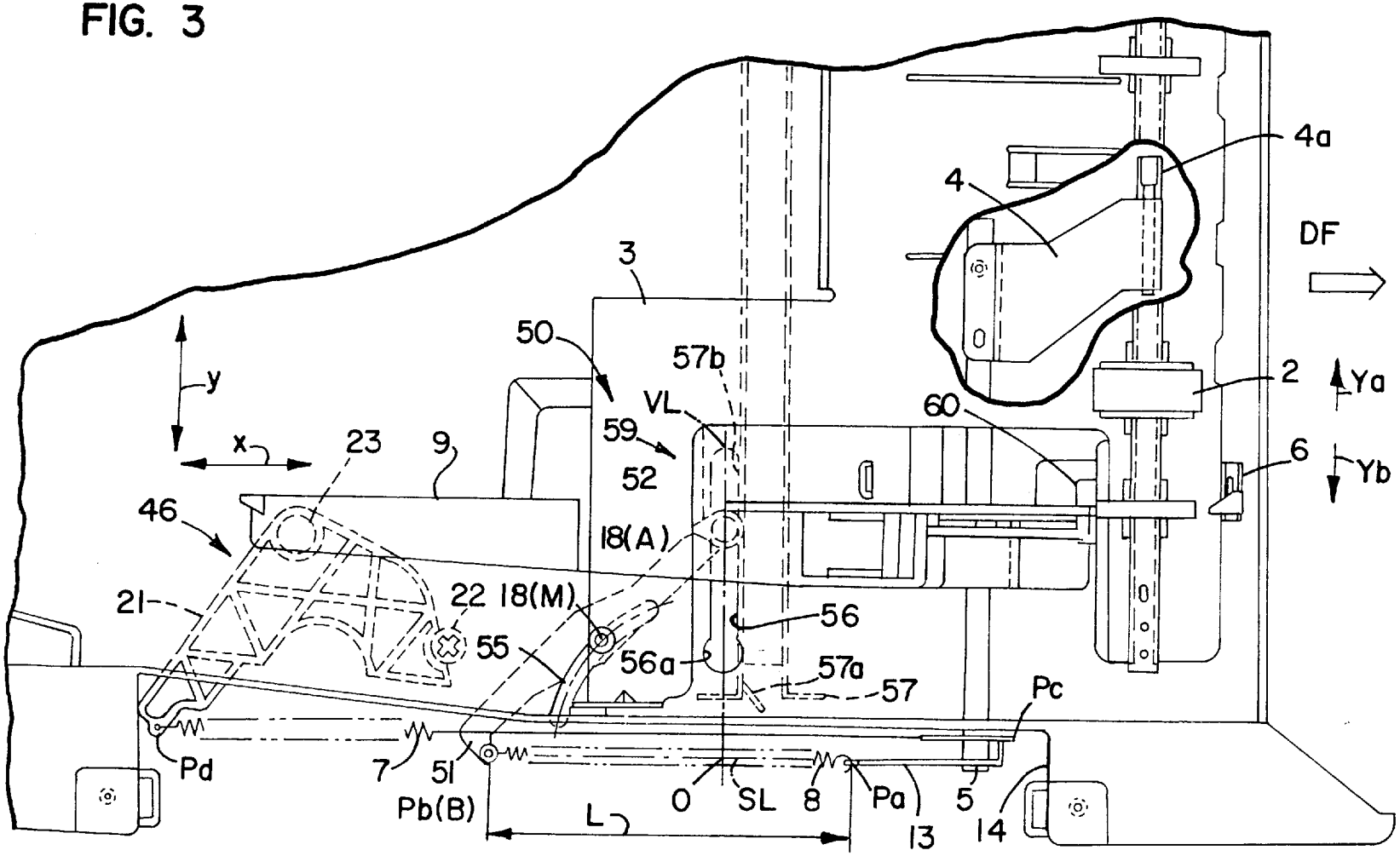
FIG. 3 is a top view of the preferred embodiment of the image-carrying medium supplying unit as shown in FIG. 2 according to the current invention.

Referring to FIG. 3, a top view of the preferred embodiment of the image-carrying medium supplying unit is illustrated according to the current invention. In general, the feeding roller 2 feeds a sheet of the image-carrying medium in a direction as indicated by an arrow DF. As the sheets are fed, the image-carrying medium holding bed 3 is pushed upwardly by the pressing bar 4 located below the bed 3 towards the feeding roller 2. The vertical movement of the bed 3 is limited by the vertical movement guide 6, a support roller 60 and a guide rotation stopper 62. One end of the pressing bar 4 contacts the bed 3 via a roller 4*a* while the other end is connected to a rotatable shaft 5.

The shaft 5 is fixedly connected to the spring connecting plate 13 and is urged by the springs 7 and 8. In general, the spring 7 is larger than the spring 8 and provides a larger force than the spring 8. The other ends of the springs 7 and 8 are respectively connected to separate structures 21 and 51 for independently but collectively exerting a force to rotate the shaft 5. As will be described later, these structures 21 and 51 provide distinct functions for optimally controlling the pressure to be applied to the bed 3. Although the preferred embodiment includes the above described two springs, the number of springs is not limited to two in order to practice the current invention.

The rotatable L-shaped latch 21 located on the bottom surface of the tray 14 is pivoted on a stationary post 23. The large spring 7 is connected at a hole Pd of the latch 21 on one end and exerts a predetermined force when the latch 21 expands the spring 7 by rotating itself in a clockwise direction to a latched position where an indentation 21*a* on the other end of the latch 21 engages a fixed post 22. The latch 21 is placed into the above described latched position when the tray 14 is inserted into a predetermined slot of the image-generating machine. As the indentation 21*a* engages the post 22, a light clicking sound is generated to confirm the correct placement of the tray in the slot. As the tray 14 is pulled out from the image-generating machine, the post 22 comes out of the indentation 21*a* and the latch 21 rotates in a counterclockwise direction.

The link arm 51 located on the bottom surface of the tray 14 moves in a more complex manner than the latch arm 21. One end 18(A) of the link arm 51 is operationally associated with a side fence 9 while the other end Pb(B) is connected to the small spring 8. The ends near the side fence 9 and the spring 8 are respectively defined as the side fence end 18(A) and the spring end Pb(B) of the link arm 51. Unlike the latch arm 21, the link arm 51 has a movable mid-point 18(M) which moves along a groove 55 as the tray 14 is inserted into the predetermined slot of the image-generating machine. The side fence end 18(A) moves along inner walls of the bore 56 which extends substantially in parallel to the direction of the travel of the tray 14 during the insertion as shown in arrows Ya and Yb. On the other hand, the spring end Pb(B) travels substantially vertical to the direction of the tray travel Ya and Yb. FIG. 3 illustrates that the tray 14 has been inserted and locked at a final insertion position.

Still referring to FIG. 3, the side fence 9 is located above the tray 14 and generally includes a pair of movable or slidable structures which projects vertically to the surface of the bed 3. However, FIG. 3 shows only one of the pair of the side fences 9. The vertically projected side fences adjustably guides a stack of the image-carrying medium placed on the bed 3. The side fence 9 slides along an axis of the width of the image-carrying medium as indicated by an arrow Y to fit any size of the image-carrying medium within a predetermined range of the width. Although the preferred embodiment as illustrated in FIG. 3 includes only a side fence for the width of the image-carrying medium, an additional or alternative slidable side fence may be included for the length of the image-carrying medium. In any case, the position of the side fence which fits the image-carrying medium indicates the size of the image-carrying medium placed on the tray 14.

Figure 4:
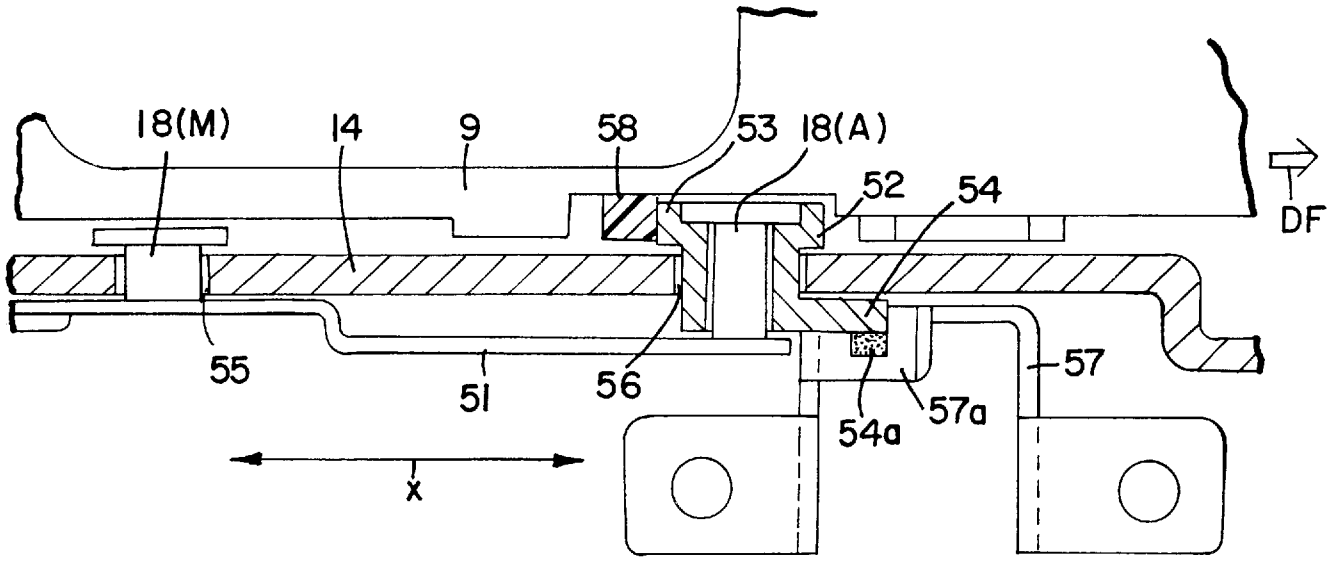
FIG. 4 is an enlarged cross sectional view of a link mechanism of the preferred embodiment as shown in FIG. 2 according to the current invention.

Now referring to FIG. 4, a cross sectional view of the link arm 51 and the associated structures along the X axis in the direction of feeding the image-carrying medium is enlarged to show the structural relationships among these elements. The side fence end 18(A) of the link arm 51 includes a upper cam 53 and a lower cam 54, and the both cams 53 and 54 are integrally formed to rotate together. The upper cam 53 slides along an inner wall of an arm link path guide 58. The arm link path guide 58 is connected to the side fence 9 or integral with the side fence 9, and the side fence 9 and the arm link path guide 58 move or slide together. The lower cam 54 and an opposite portion 52 of the upper cam 53 sandwiches an inner edge wall of the bore 56 on the tray 14 during the above described movement. According to one preferred embodiment of the lower cam 15 according to the current invention includes a rotational restriction portion 54*a* to limit the freedom of rotation of the lower cam 54 and consequently the upper cam 53. Although this portion 54*a* ascertains the correct operation of the link arm 51, it is not necessary for the practice of the current invention. Behind the lower cam 54 is an angled portion 57*a* of the guide plate 57 fixedly located in the slot of the image-generating machine. The mid-point post 18(M) travels along the groove 55. The precise movements of the link arm 51 and in particular the rotation of the cams 53 and 54 during the insertion of the tray 14 into a predetermined slot of the image-generating machine will be described in details with respect to FIGS. 5, 6 and 7.

Figure 5:
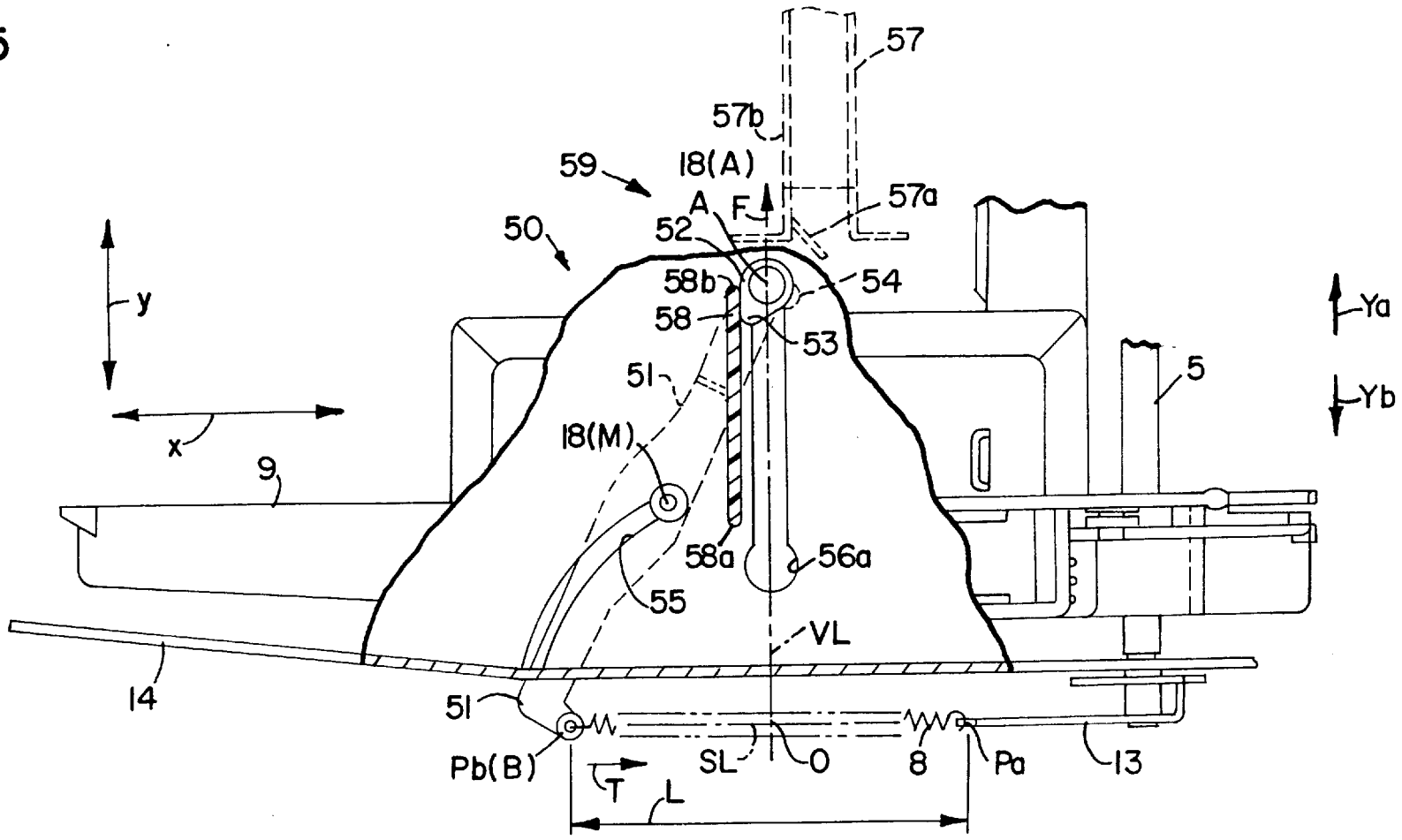
FIG. 5 is an enlarged top sectional view of the link mechanism of the preferred embodiment as shown in FIG. 2 when the image-carrying supplying unit has been just inserted in an image-generating machine according to the current invention.

Now referring to FIG. 5, after a pile of the image-carrying medium has been already placed on the tray and the side fences 9 have been also adjusted to fit the size of the image-carrying medium, the tray 14 is at an initial stage of the insertion into the image-generating machine as indicated by an arrow Ya. For the sake of the simplicity, only spring 8 and its associated structures are shown in FIG. 5. The side fence end 18(A) is located near an initiation end 58*b* of the link arm path guide 58. The upper cam 53 slides along the inner wall of the link arm path guide 58 as the tray 14 is being pushed into the image-generating machine in the Ya direction and the link arm 51 initiates the orthogonal movement conversion. In other words, the Ya directional movement of the tray insertion is converted by the linkarm 51 into the X directional movement to initiate the expansion of the small spring 8 at the spring end Pb(B) of the link arm 51.

Figure 6:
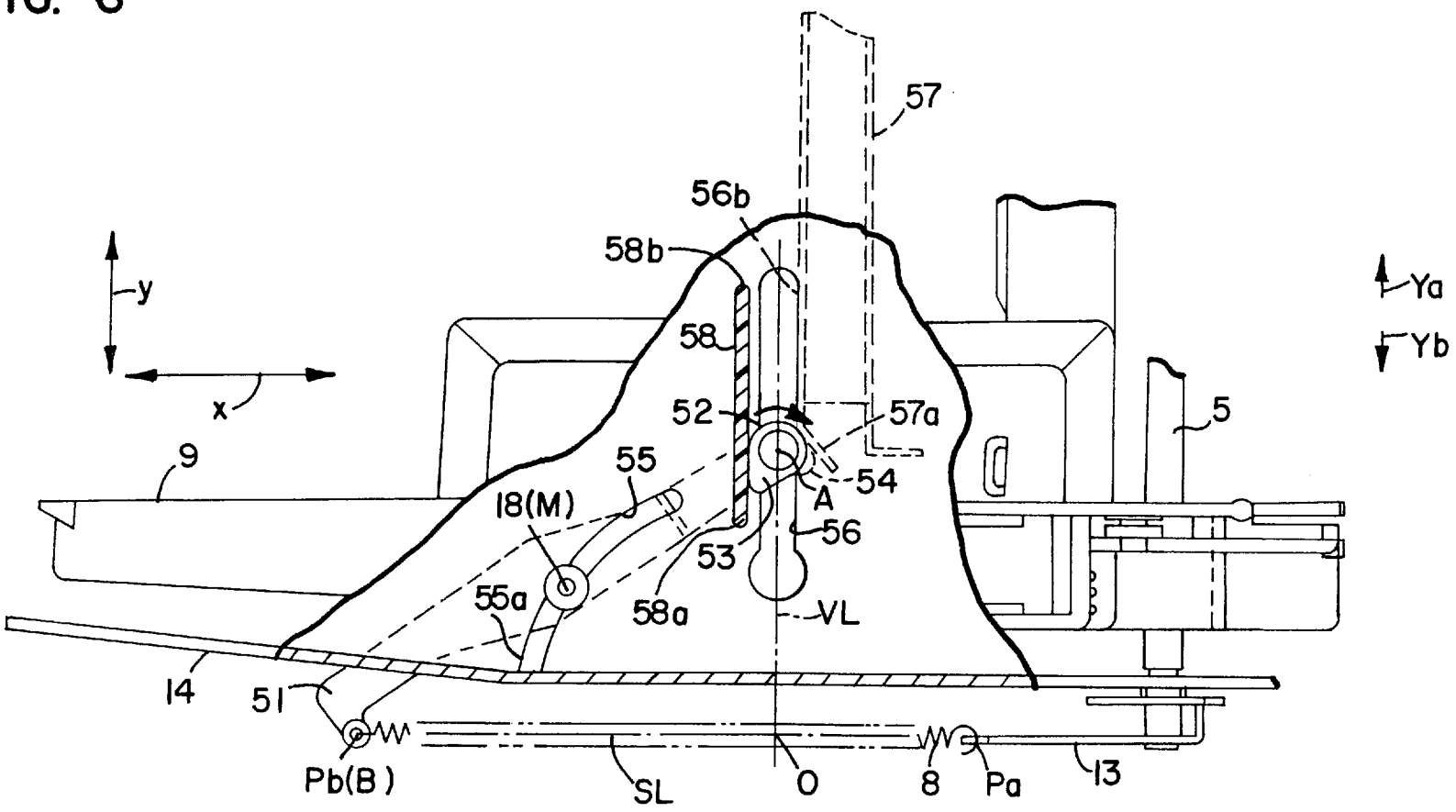
FIG. 6 is an enlarged top sectional view of the link mechanism of the preferred embodiment as shown in FIG. 5 when the image-carrying supplying unit has been further inserted in an image-generating machine according to the current invention.

As the tray 14 is further inserted into the image-generating machine in the direction of Ya, referring to FIG. 6, the side fence end 18(A) travels downwardly along the inner wall of the link arm path guide 58 towards a turning end 58*a*. At the same time, the mid-point 18(M) also travels along the groove 55 towards a distal end 55*a*. As the link arm 51 turns in the above described clock wise direction, the spring end further expands the spring 8. During the course of these movements, the lower cam 54 as shown in the dotted line comes into contact with the stationary angled portion 57*a*. Upon the contact, the angled portion 57*a* initiates the rotation of the lower cam 54 in the clockwise direction. Although this rotational movement of the lower cam 54 causes the upper cam 53 to also rotate in the same direction, the cam 53 and 54 are prevented from rotating in the clockwise direction since the upper cam 53 is placed against the link arm path guide 58. The upper cam 53 thus travels along the surface of the link arm path guide 58 towards the turning end 58*a* without rotation while lower cam 53 is exerting the clockwise rotation force.

Figure 7:
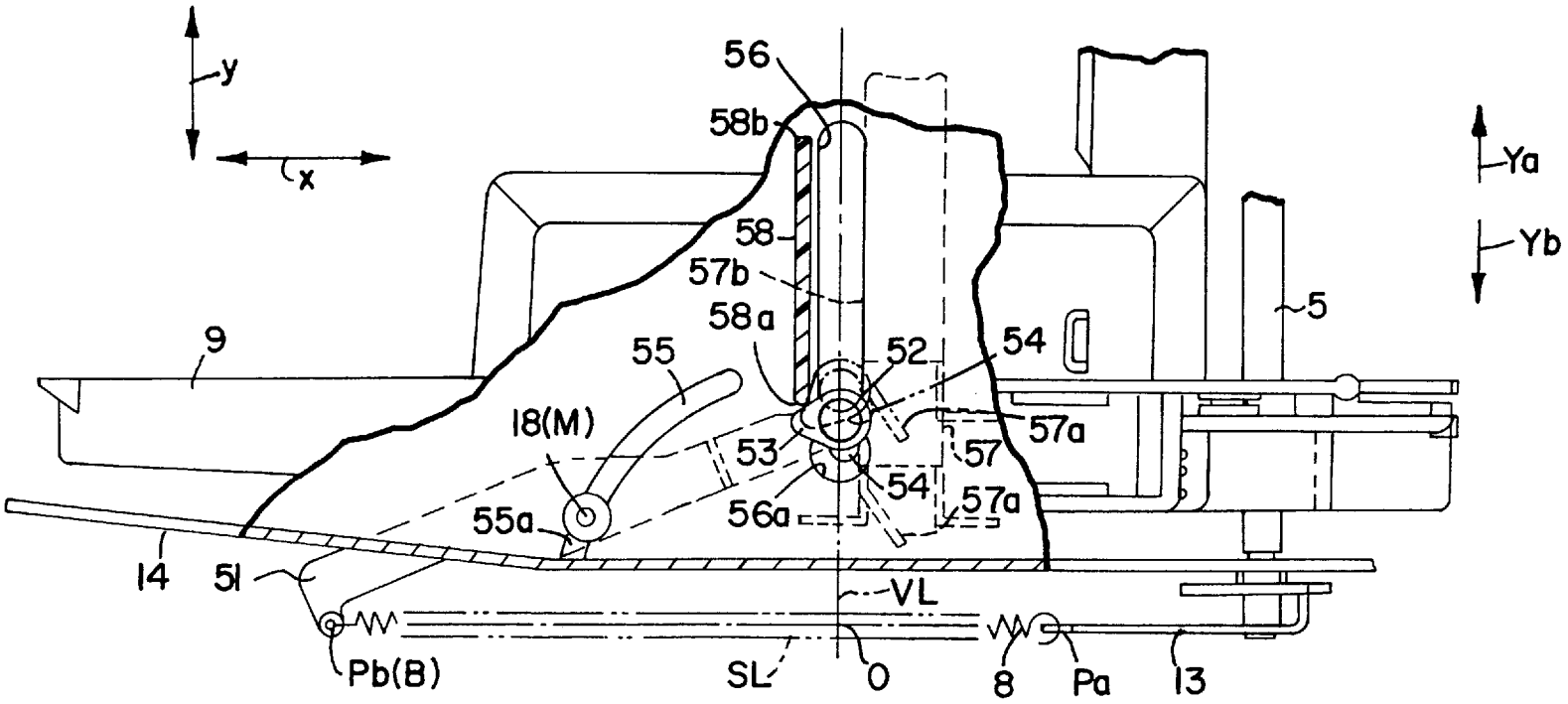
FIG. 7 is an enlarged top sectional view of the link mechanism of the preferred embodiment as shown in FIG. 6 when the image-carrying supplying unit has been locked in an image-generating machine according to the current invention.

Now referring to FIG. 7, as the tray 14 is further inserted towards a predetermined locked or fully inserted position, the upper cam 53 is rotated around the turning end 58*a* because the lower cam 54 is urged to be rotated in the clockwise direction by the stationary angled portion 57*a*. The double dotted lines indicate an initial stage of the rotation of the cams 53 and 54 around the turning end 58*a* while the solid lines indicate a final stage of the rotation. The cams 53 and 54 have turned approximately 90° in a clockwise direction. As a result, the upper cam 53 is positioned at a substantially vertical position to the link arm pathguide 58 and prevents further insertion of the tray. The lower cam 54 is positioned in a substantially parallel position to the direction of the insertion, and a certain portion of the lower cam 54 now contacts an inner wall of the straight guide portion 57*b*. Since the upper cam 53 and the lower cam 54 are disposed at a predetermined angle with each other, the cams 53 and 54 are now respectively placed against the distal end 58*a* and the straight portion 57*b* and secure a stable position of the side fence end 18(A) of the link arm 51 at this fully inserted tray position. A light clicking sound is generated as the cams 53 and 54 are placed into the locked position to confirm the correct placement of the tray in the slot.

At this secured position, the mid-point 18(M) has moved even closer to the distal end 55*a*, and the spring end Pb(B) has also further moved to a predetermined final extended position. As described above, the position of the turning end 58*a* of the link arm path guide 58 determines the final position of the side fence end 18(A). The position of the side fence end 18(A) in turn determines the spring end Pb(B) position. The spring 8 is thus expanded to a length determined by the link arm path guide position, and the link arm 51 is locked to maintain the same position until the tray is take out for resupplying the image-carrying medium.

Referring to FIGS. 3, 5, 6 and 7, in order to replenish the image-carrying medium, the tray 14 is taken out from the above described secured position in the image-generation machine by moving in an opposite direction Yb. In general, movements and rotations during the tray removal take place in the directions opposite to the above described movements and rotations during the tray insertion. In particular, the cams 54 and 54 rotate in the counterclockwise direction (opposite to the arrow as shown in FIG. 6) when the lower cam 54 engages the angled portion 57*a* of the stationary cam guide 57 as the tray 14 travels in the Yb direction. After the counterclockwise rotation, the side fence end 18(*a*) of the link arm 51 moves toward an initiation end 56*b* in the bore 56 as shown in FIGS. 6 first and then in FIG. 5. During the course of the above described movement of the side fence end 18(A), the spring end Pb(b) also travels in a reverse direction towards the spring connecting plate 13 to release the expanded spring 8. Now referring back to FIG. 3, similarly, the large spring 7 is also released from the expanded position as the tray 14 is pulled out from the slot in the image-generating machine. As a result, when the tray 14 is detached from the image-generating machine, neither of the springs 7 nor 8 urges the bed 3. For this reason, it is a great advantage that a user does not have to push down the remaining stack or the bed 3 towards the bottom of the tray 14 to replenish a new stack of the image-carrying medium.

Figure 8:
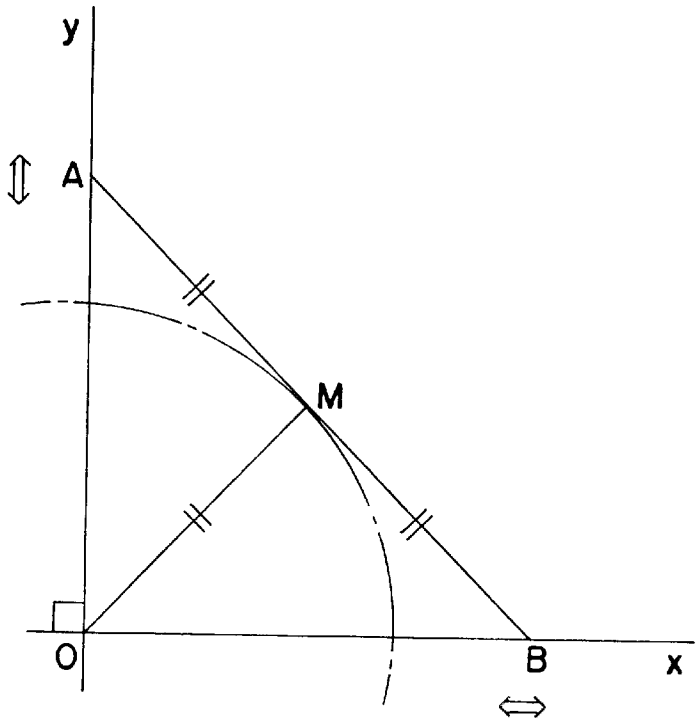
FIG. 8 is a graph showing a relationship in the displacement among the predetermined portions of a movable link arm.

The above described movements of the link arm 51 during the tray insertion for expanding the spring 8 and the tray removal for releasing the spring 8 are summarized in a graph shown in FIG. 8. The X axis indicates an amount of movement at the spring side Pb(B) while the Y axis indicates an amount of movement at the side fence side 18(A). One example of the movement is indicated by the straight line connecting points A and B for showing the amount of the vertical movement and the horizontal movement. The mid-point 18(M) moves in a circumference of a circle whose radius OM is substantially the same as the distance between the mid-point 18(M) and the side fence end 18(A) or the distance between the mid-point 18(M) and the spring side Pb(B). In other words, the distances OM, AM and BM are all substantially equal.

Figure 9:
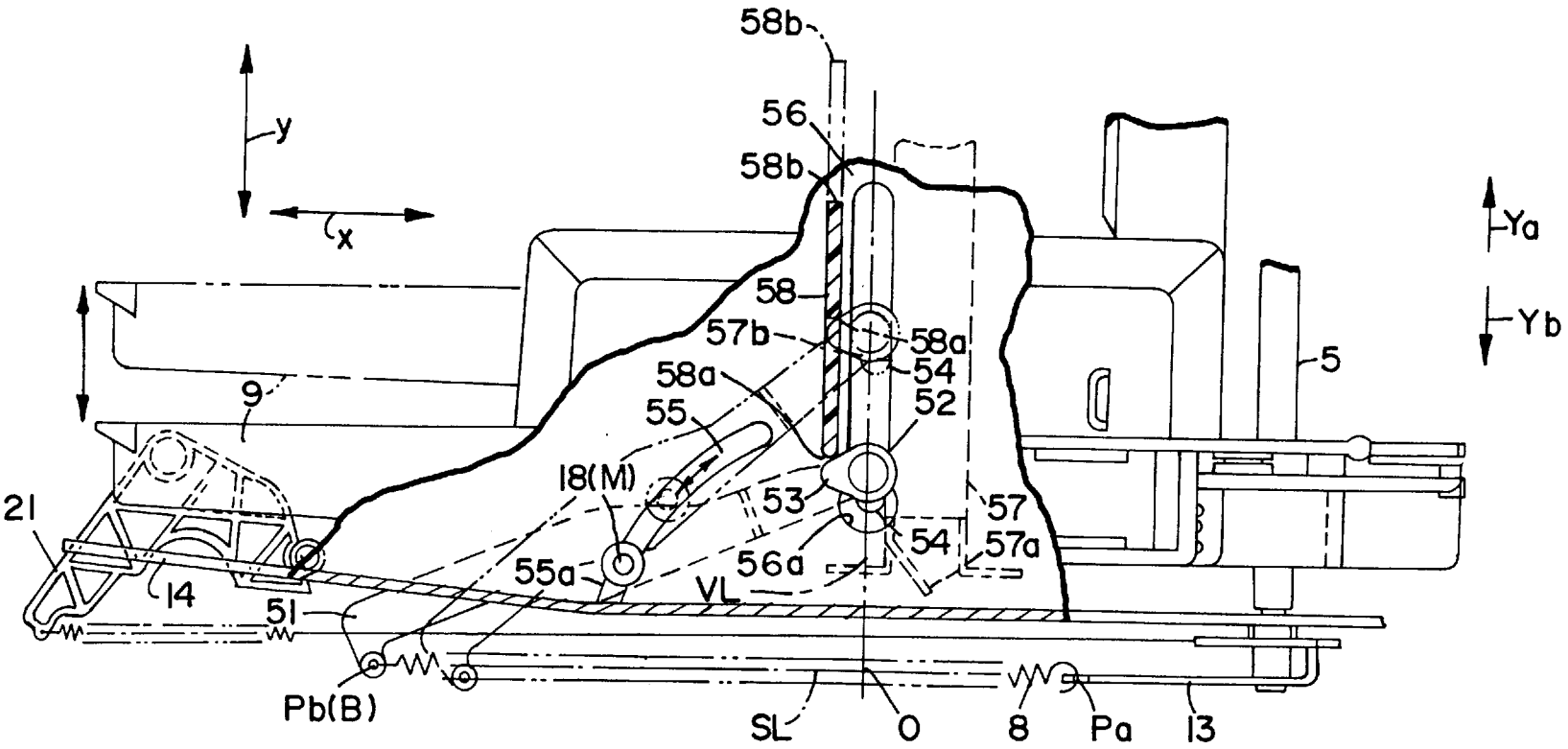
FIG. 9 is an enlarged top sectional view of the link mechanism of the preferred embodiment as shown in FIG. 2 for illustrating a different position of the link arm in proportion to the position of the side fence according to the current invention.

Now referring to FIG. 9, the side fence 9 is moved at any position within a predetermined range in the width of the image-carrying medium. In general, since the link arm path guide 58 also moves along the side fence 9, a position of the side fence 9 determines the position of the link arm path guide 58. In this regard, the side fence 9 or the link arm path guide 58 is an indicator for the size of the image-carrying medium placed on the tray 14. As described above, the position of the turning end 58*a* of the link arm path guide 58 determines how far the spring 8 is expanded. The effect of the positions of the link arm path guide 58 on the spring expansion is illustrated in FIG. 9 by superimposing different positions of the link arm path guide 58, the side fence 9 and the link arm 51. In other words, the smaller the size of the image-carrying medium, the closer the side fences 9 are placed together in the Y direction as indicated by the double dotted lines. Since the turning end 58*a* of the link arm path guide 58 is moved to a location as indicated by the double dotted lines from the position indicated by the solid lines, the upper cam 53 is allowed to rotate at the moved position of the turning end 58*a* as shown in the double dotted lines. As a result of this rotation of the upper cam 53, the spring 8 is expanded less to exert a smaller pressure for accommodating the smaller size image-carrying medium than the position indicated by the solid lines. However, the placement of the side fence within the predetermined range is not limited to indicate commonly used sizes such as A4 and a letter size according to the current invention. Any size within the predetermined range is accommodated, and the linear or proportional force corresponding to the specified size is exerted by adjusting the spring expansion according to the current invention.

Still referring to FIG. 9, when the tray 14 is fully inserted into the image-generating machine, a plurality of springs 7 and 8 is collectively exerting an optimal pressure to the bed 3. As described above, the large spring 7 is expanded to a predetermined constant length regardless of the size of the image-carrying medium. On the other hand, the small spring 8 is variably expanded in proportion to the size of the image-carrying medium. Thus, the force exerted by these two springs 7 and 8 is collectively applied to the bed 3 via the pressing bar 4 in order to accommodate any size of the image-carrying medium within a predetermined range. This optimal initial pressure is then continuously adjusted to a predetermined final pressure as the stack of the image-carrying medium on the bed is decreased. This continuous adjustment is accomplished by the counterclockwise rotation of the spring connecting plate 13 due to the decreasing total weight and height of the stack on the bed 3. As the stack decreases, the force applied to the bed 3 overcomes the decreased weight and rotates the spring connecting plate 13 in the counterclockwise direction to shorten the length of both springs 7 and 8. The force exerted by the springs 7 and 8 continues to decrease to the predetermined final pressure for the last sheet of the image-carrying medium on the tray 14.

Figure 10:
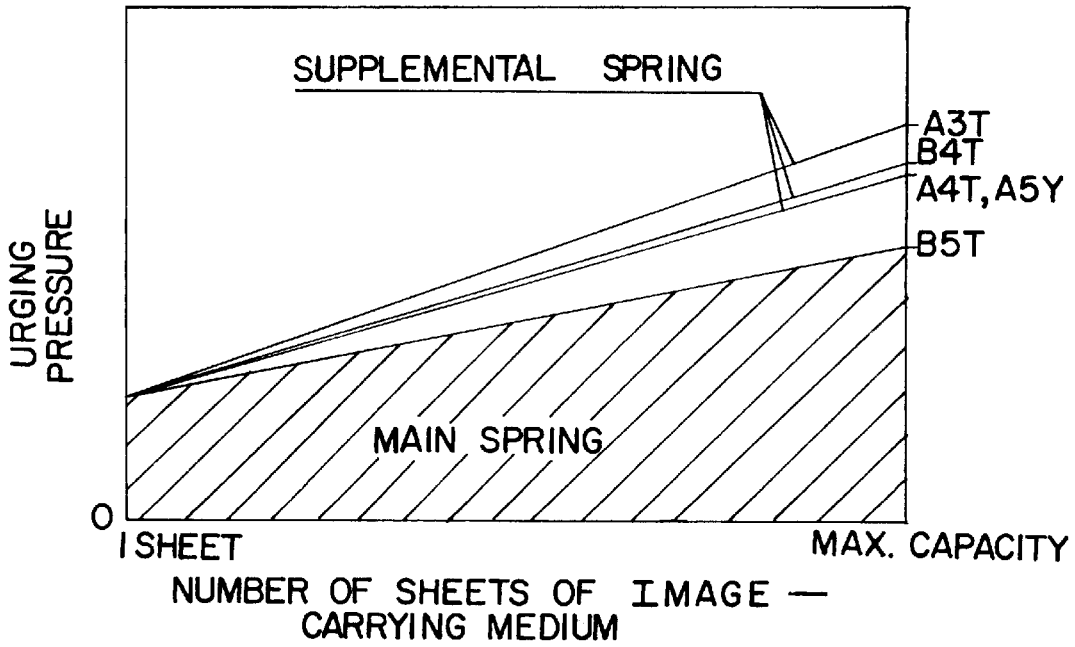
FIG. 10 is a graph illustrating that an amount of the pressure exerted on the image-carrying holding unit by springs is in proportion to the paper size and at least one of the springs is variable based upon the size of the image-carrying medium according to the current invention.

FIG. 10 is a graph illustrating the above described constant and variable force or pressure generated by the two springs and their associated structures. The large spring 7 exerts a constant initial force designated by the BT5 when the tray 14 is fully loaded regardless of the size of the image-carrying medium. The initial B5T force is decreased at a constant rate as the full load of the image-carrying medium is fed into an image-generating machine. On the other hand, the second initial force exerted by the small spring 8 depends upon the size of the image-carrying medium placed on the tray. The second initial force is respectively designated as A3T, B4T and A4T for the corresponding size of the image-carrying medium, and one of these initial force is selected based upon the size of the image-carrying medium placed on the tray. The selected initial force is also continuously decreased until the last sheet of the image-carrying medium remains on the bed. The small spring 8 and the large spring 7 both decrease its force towards substantially the same amount for the last sheet of the image-carrying medium according to the current invention. Although FIG. 10 illustrates the forces or pressure exerted by the springs for the predetermined commonly used medium sizes, as described before, the optimal initial force is adjusted for any size within a predetermined range according to the current invention. In other words, the size is adjustable in a continuous manner to any non-standard size within the predetermined range.

Figure 11:
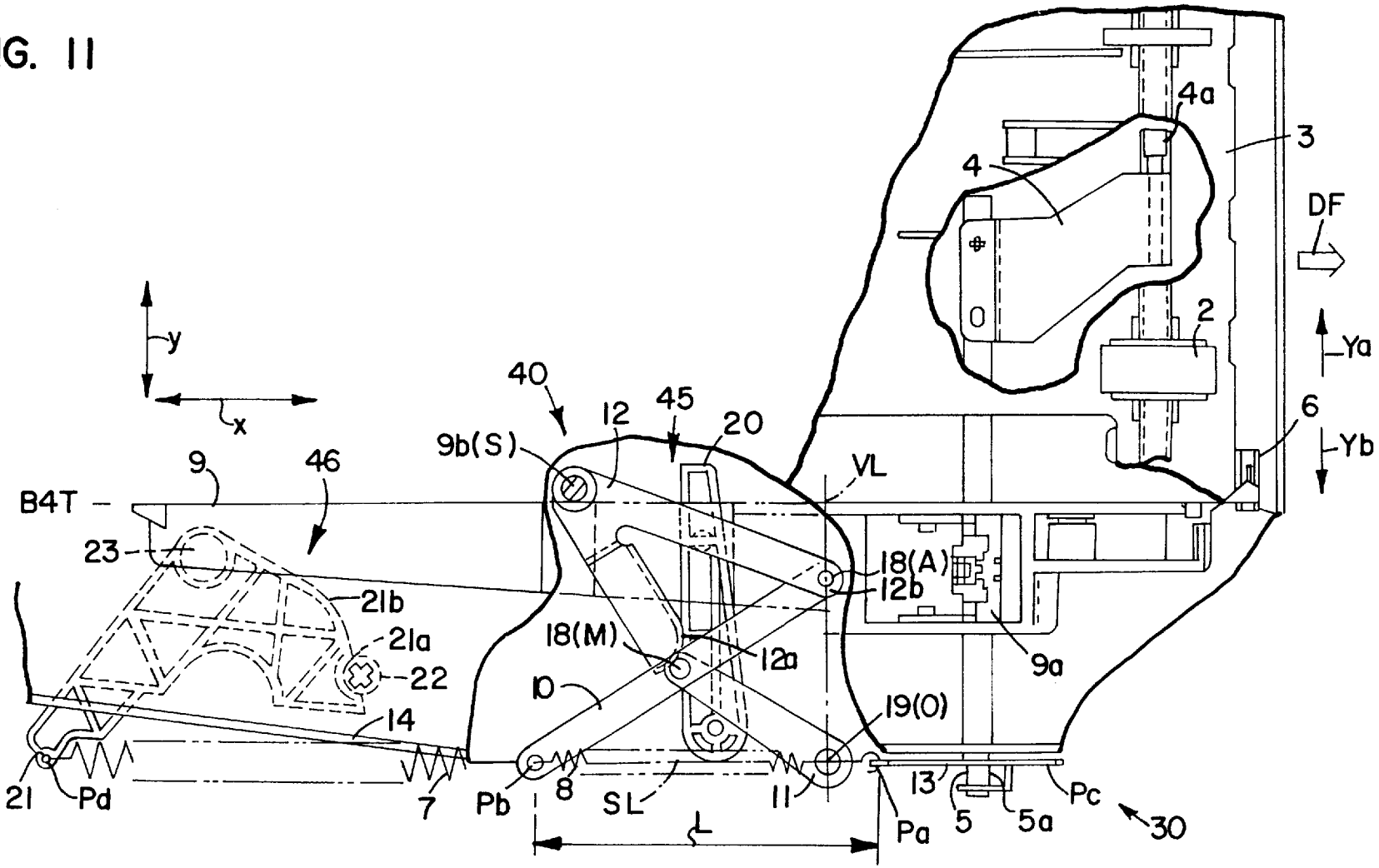
FIG. 11 is a top view of the alternative embodiment of the image-carrying medium supplying unit according to the current invention.

Now referring to FIG. 11, a top view of a second embodiment of the image-carrying medium supplying unit according to the current invention is illustrated. Since many components are substantially identical to ones already described with respect to the first embodiment, and these substantially identical components are designated by the same reference numerals as used for the first embodiment, the descriptions are not reiterated but incorporated herein. The distinct structures of the second embodiment include the multiple link arms 40, which convert the movement in the Y direction into an orthogonal movement in the X direction based upon the position of the side fence 9. In general, the multiple link arms 40 include a V-shaped link arm 12, a long link arm 10 and a short arm link 11. As the tray 14 is inserted into a predetermined slot of an image-generating machine in the Ya direction, a distal end 12*a* of the V-shaped link arm 12 is pushed by a guide 20 fixedly located on an image-generating machine, and the multiple link arms move in a way to move a spring end Pb(B) of the long link arm 10 away from a spring connecting plate 13 to expand the spring 8.

Figure 12:
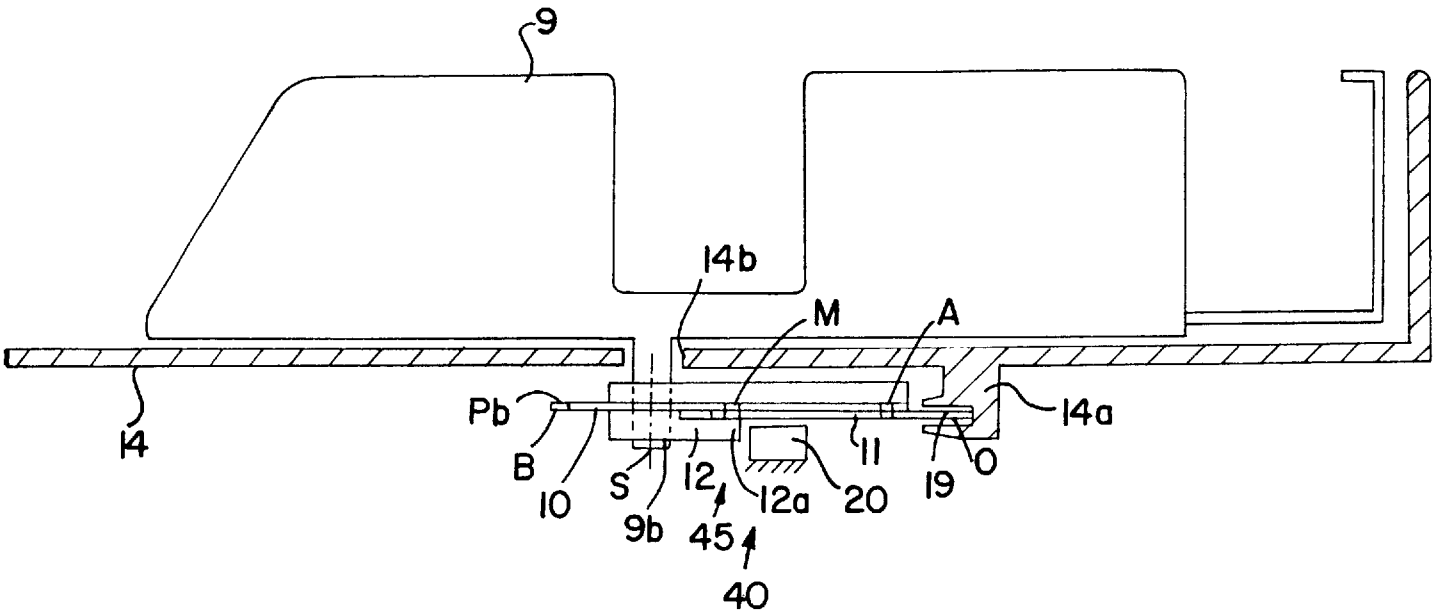
FIG. 12 is an enlarged cross sectional view of the link structure of the alternative embodiment as shown in FIG. 11 according to the current invention.

Now referring to FIG. 12, a cross sectional view of the second preferred embodiment in the vicinity of the multiple link arms 40 is illustrated. A side fence 9 slides on the surface of the tray 14 along the width of the image-carrying medium. As the side fence changes its position, the post S integrally formed with the bottom of the side fence 9 also travels along a bore 14*b*. The V-shaped link arm is pivoted on the post S. A distal end of a shorter portion 12*a* of the V-shaped link arm 12 faces a stationary guide 20 which is located on an image-generating machine. A distal end of a longer portion 12*b* of the V-shaped link arm 12 has a post A projecting downwardly to pivot one end of the long link arm 10. The other end of the long link arm 10 has a bore Pb(B) to connect the spring 8. A mid-point of the long link arm 10 has another post M also projecting downwardly to pivot one end of the short link arm 11. The other end of the short link arm is pivoted by a post O which is located at the bottom of the tray 14.

Referring back to FIG. 11, the posts O and A are substantially aligned on a line VL parallel to the wall of the stationary guide 20 when the tray is fully inserted in the slot and the distal end 12*a* contacts the stationary guide 20. An inner wall surface of the stationary guide 20 facing the link arm 12*a* is substantially perpendicular to the X direction.

Figure 13:
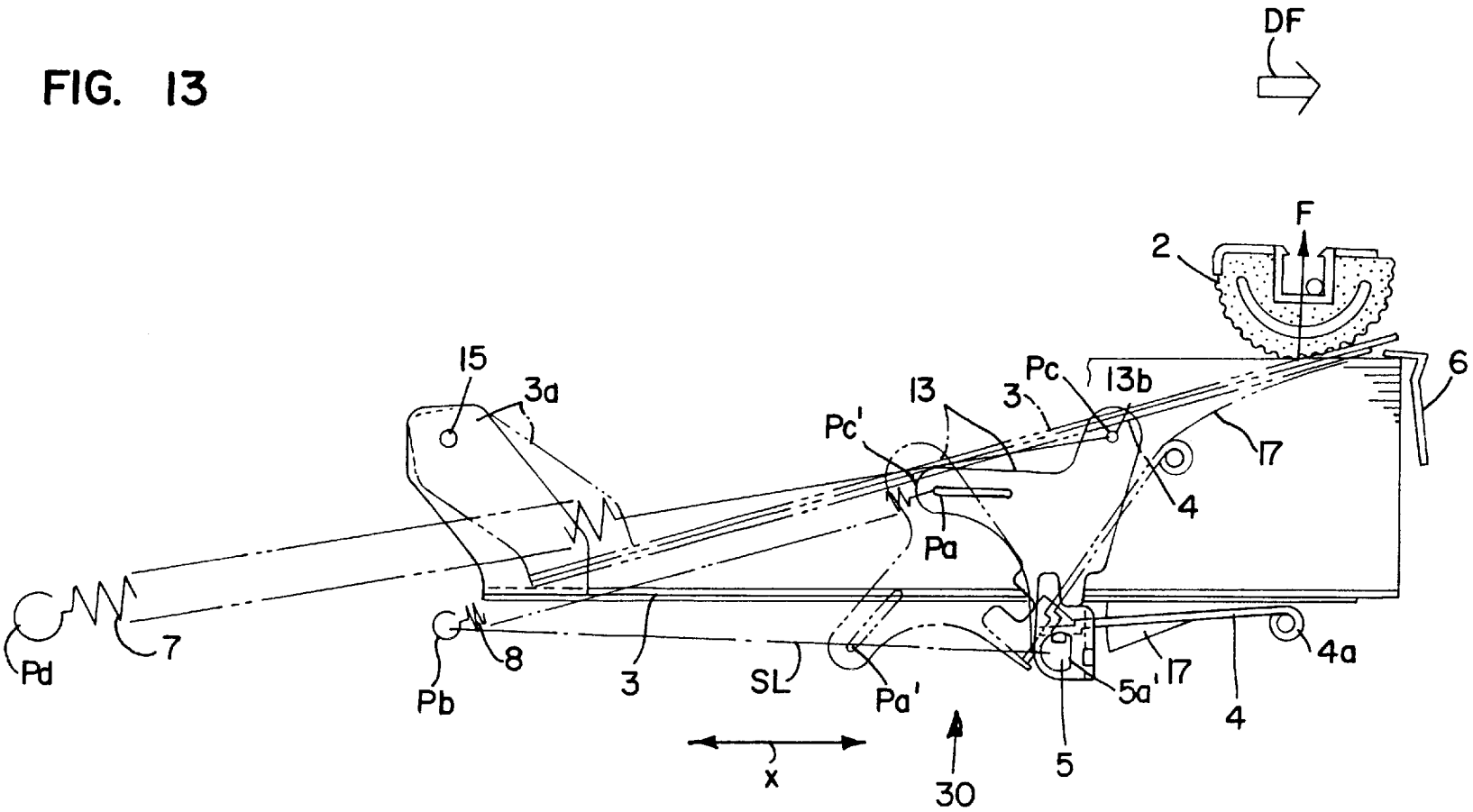
FIG. 13 is a side view of an alternative embodiment of the image-carrying medium supplying unit as shown in FIG. 11 according to the current invention.

Now referring to FIG. 13, a side view of the second embodiment of the image-carrying medium supplying unit is illustrated. In general, the structures in the second embodiment are substantially identical to the corresponding structures of the first embodiment as described with respect to FIG. 2. The corresponding structures are also referenced by the same reference numbers. For these reasons, the descriptions of the substantially identical elements are not duplicated but incorporated herein. Although the configuration of a spring connecting plate 13 in the second embodiment is slightly different from that of the first embodiment, the function of these spring connecting plates 13 is essentially identical as will be described below with respect to FIGS. 14A and 14B.

Figure 14A:
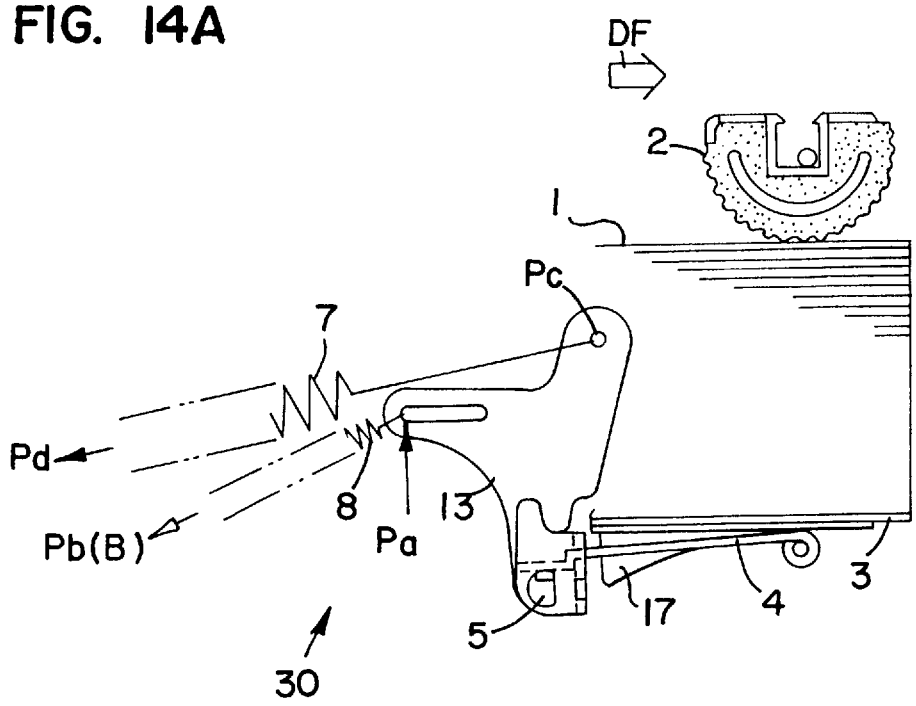
FIGS. 14A and 14B respectively show a positional of a spring connecting plate of the alternative embodiment at a full load position and a near empty position according to the current invention.

Referring to FIG. 14A, the position of the spring connecting plate 13 is almost upright when the bed 3 has a full load of the image-carrying medium 1 near a maximum capacity. The spring connecting plate 13 and the pressing arm 4 are rotatably placed on a shaft 5. One end of the springs 7 and 8 is respectively engaged with a bore Pc and Pa of the spring connecting plate 13. At this fully loaded position, the pressing arm 4 is almost parallel to the bed 3. Both springs 7 and 8 exert a rotational force on the spring connecting plate 13 at respective predetermined angles and cause the spring connecting plate 13 to rotate about the shaft 5 in the counterclockwise direction. As a result, the bed 3 is lifted towards a feeding roller 2 via the pressing bar 4.

Figure 14B:
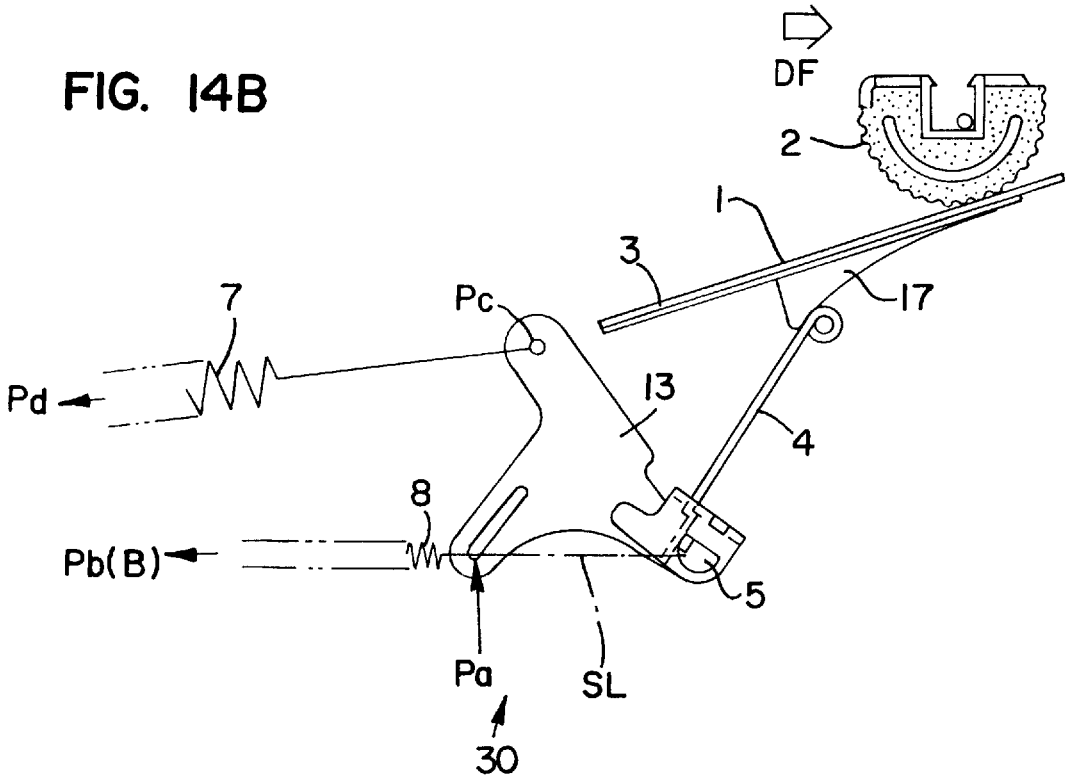

Now referring to FIG. 14B, the last sheet of the image-carrying medium 1 remains on the bed 3 against a feeding roller 2. At this near empty situation, the bed 3 is lifted by the pressing arm 4 via the rotated spring connecting plate 13. The spring connecting plate 13 has rotated about the shaft 5 in a counterclockwise direction from the above described fully loaded position. At this rotated near empty position, the bore Pa is substantially in line with the rotatable shaft 5. Because of this alignment, the spring 8 no longer exerts any significant rotational force on the spring connecting plate 13 regardless of its initially adjusted force. The lift force on the bed 3 at this near empty condition is provided solely by the spring 7, which is not aligned with the rotational center.

The above described predetermined angles for the two springs 7 and 8 with respect to the spring connecting plate 13 in the second embodiment as shown in FIGS. 14A and 14B are also provided by the spring connecting plate 13 of the first embodiment as shown in FIG. 2. Referring back to FIG. 2, at the near empty condition, as indicated by the double dotted lines, since the bore Pa connecting the spring 8 is in alignment with the rotatable shaft 5, the spring 8 exerts no substantial rotational force on the spring connecting plate 13 in the first embodiment.

Now referring to FIGS. 15, 16, 17 and 18, these top views of the second embodiment of the image-carrying medium supplying unit according to the current invention collectively illustrate how the multiple link arms 40 adjust to various sizes of the image-carrying medium. Although the examples shown in these figures are commonly known sizes of the image-carrying medium, the multiple link arms 40 are able to adjust to any size within the predetermined range so as to expand the spring 8 to an optimal length. The predetermined range illustrated in this example covers from B5T to A3T. In general, the solid lines in each of the above figures illustrate the multiple link arms at a tray-inserted position while the double dotted lines illustrate the multiple link arms at a tray-removed position. The other spring 7 and the associated structures are not shown in FIGS. 15–18.

Figure 15:
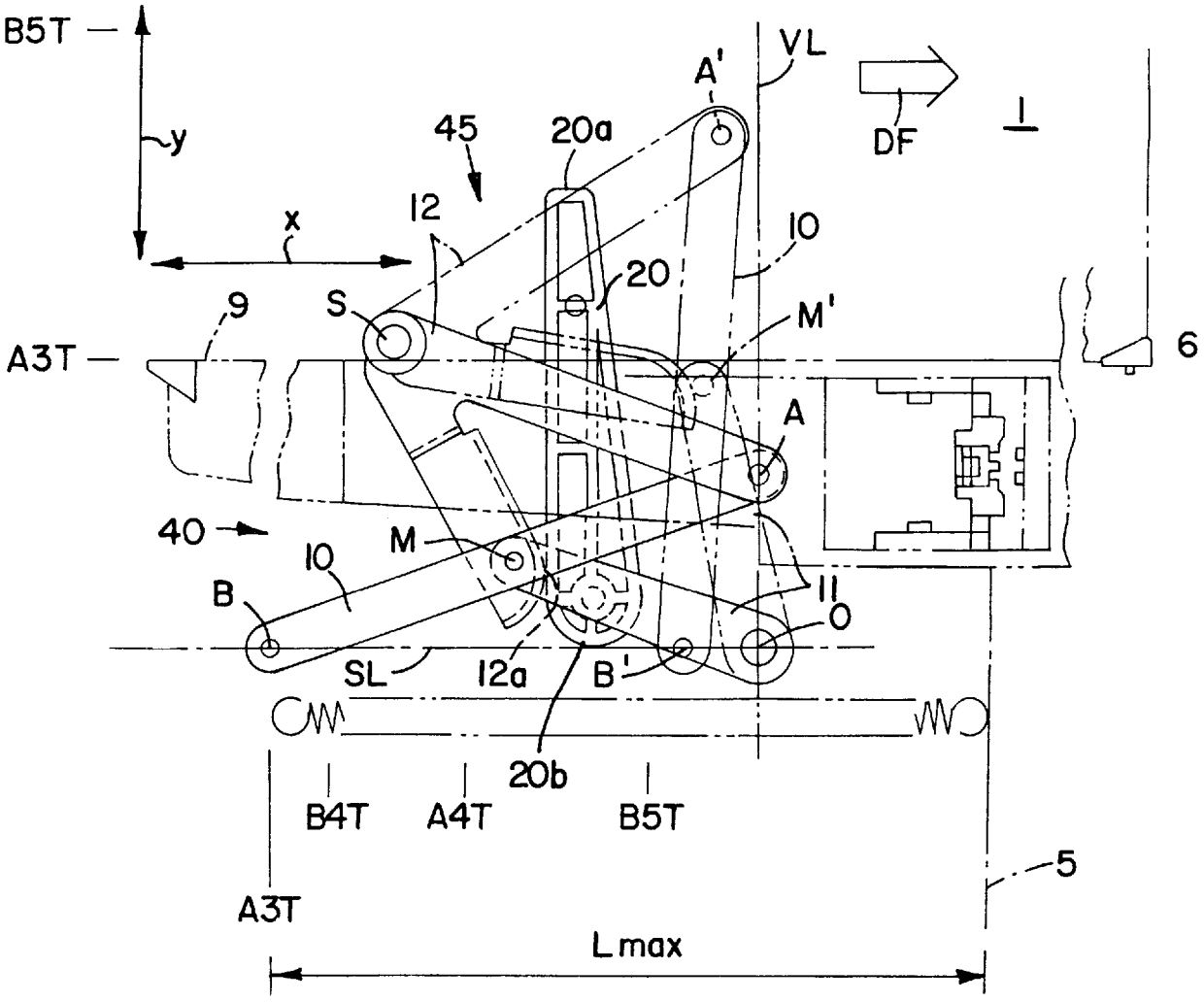
FIG. 15 is an enlarged top view of the link structure of the alternative embodiment for illustrating a extended position for the max extension of a spring and a released position according to the current invention.

Referring to FIG. 15, a pile of A3T image-carrying medium is loaded on the tray and a movable side fence is moved to adjust to fit the width of the image-carrying medium. As the above described loaded tray is inserted in the Y direction, an distal end of a short arm 12*a* contacts one end 20*a* of a stationary arm guide 20 located on an image-generating machine. As the insertion continues, the short arm 12*a* slides along a surface of an inner wall of the stationary guide 20 towards the other end 20*b*. A V-shaped link arm 12 thus rotates in a clockwise direction about a post S, and the rotation causes the movement of a long link arm 10 which is pivoted on a post A located at the end of the long arm of the V-shaped link arm 12. However, since the long link arm 10 is also pivoted on a post M which is linked to a short link arm 11, the other end of the long link arm is restricted to move on a line perpendicular to the direction of the tray insertion. At the fully inserted position, the spring 8 is expanded to a predetermined length Lmax for A3T size which is determined by the position of the post S.

Still referring to FIG. 15, as the tray is removed from the image-generating machine, in general, the reverse movements and rotations take place. As the short link arm 12*a* passes beyond the end 20*a* of the guide structure 20, the short link arm 12*a* is allowed to rotate in the counterclockwise direction. As a result, the spring 8 is released from the expanded position, and the multiple link arms 40 assume the released position as indicated by the double dotted lines.

Figure 16:
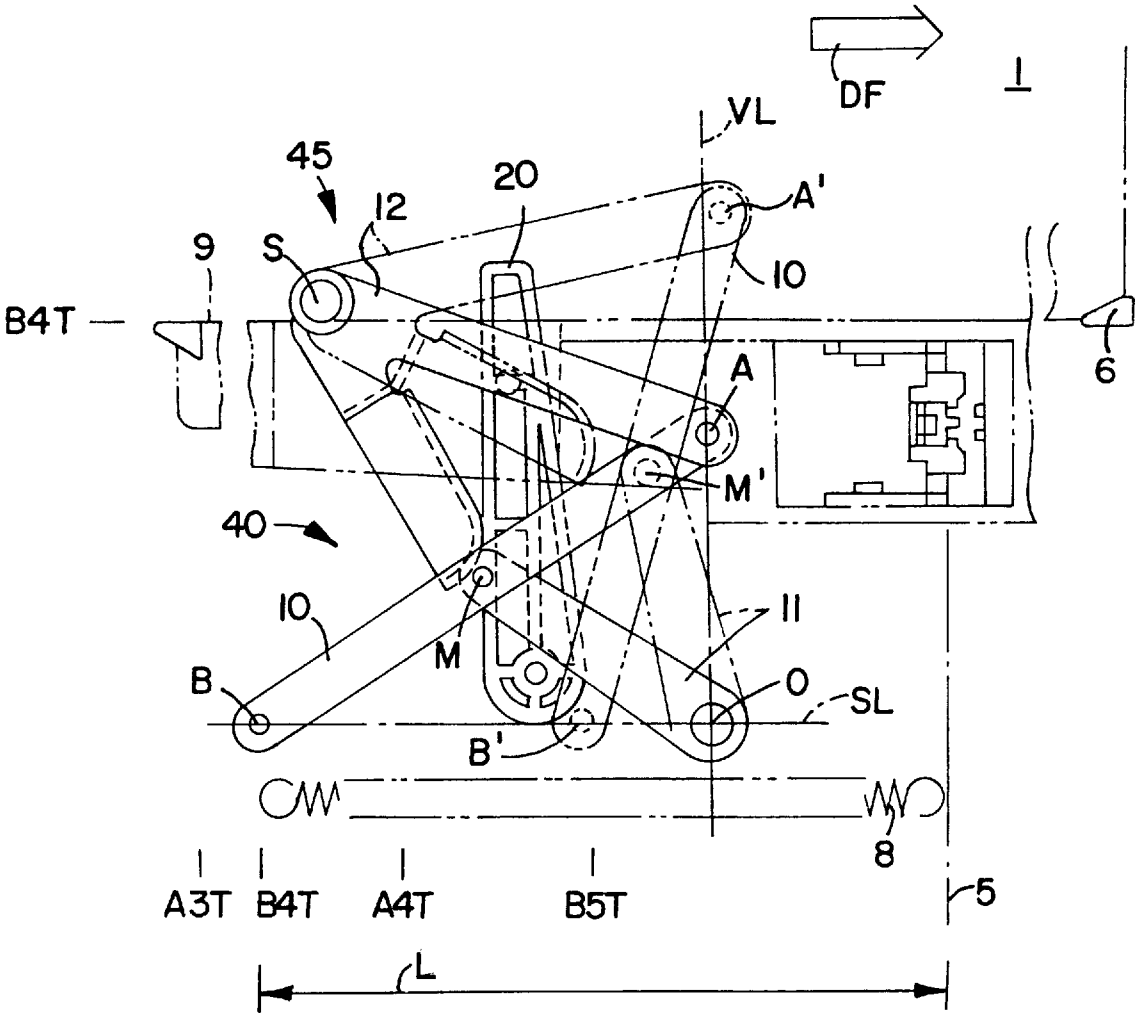
FIG. 16 is an enlarged top view of the link structure of the alternative embodiment for illustrating a extended position for a predetermined first extension of a spring and a released position according to the current invention.
Figure 17:
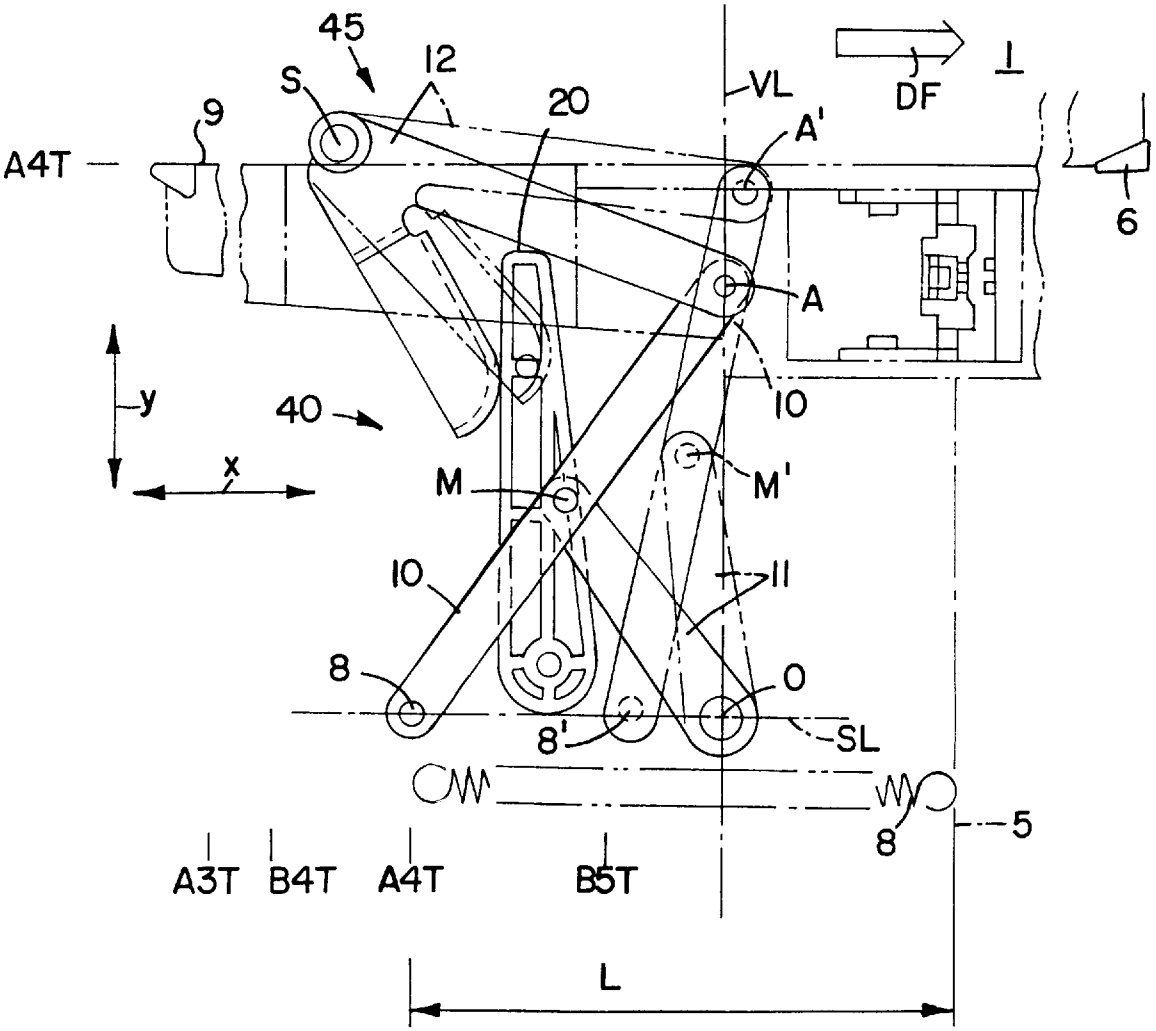
FIG. 17 is an enlarged top view of the link structure of the alternative embodiment for illustrating a extended position for a predetermined second extension of a spring and a released position according to the current invention.

Referring to FIGS. 16 and 17 at the same time for comparison purposes, the side fence position is respectively moved to accommodate B4 and A4 sized image-carrying media. As the side fence is moved, the post 9 is also placed at the corresponding positions. The smaller the size is, the further the post S is placed from a distal end 20*b* of the stationary guide 20. The distal end B of the long link arm 10 travels less distance as the post is placed farther away from the distal end 20*a* of the guide 20. Thus, the spring 8 is expanded less for the A4T sized image-carrying medium than the B4T sized image-carrying medium. As described above, based upon the position of the post S, a predetermined amount of expansion of the spring 8 results after the tray is inserted in the image-generating machine. However, when the tray is removed from the image-generating machine, the long link arm returns to the same released position as shown in these figures.

Figure 18:
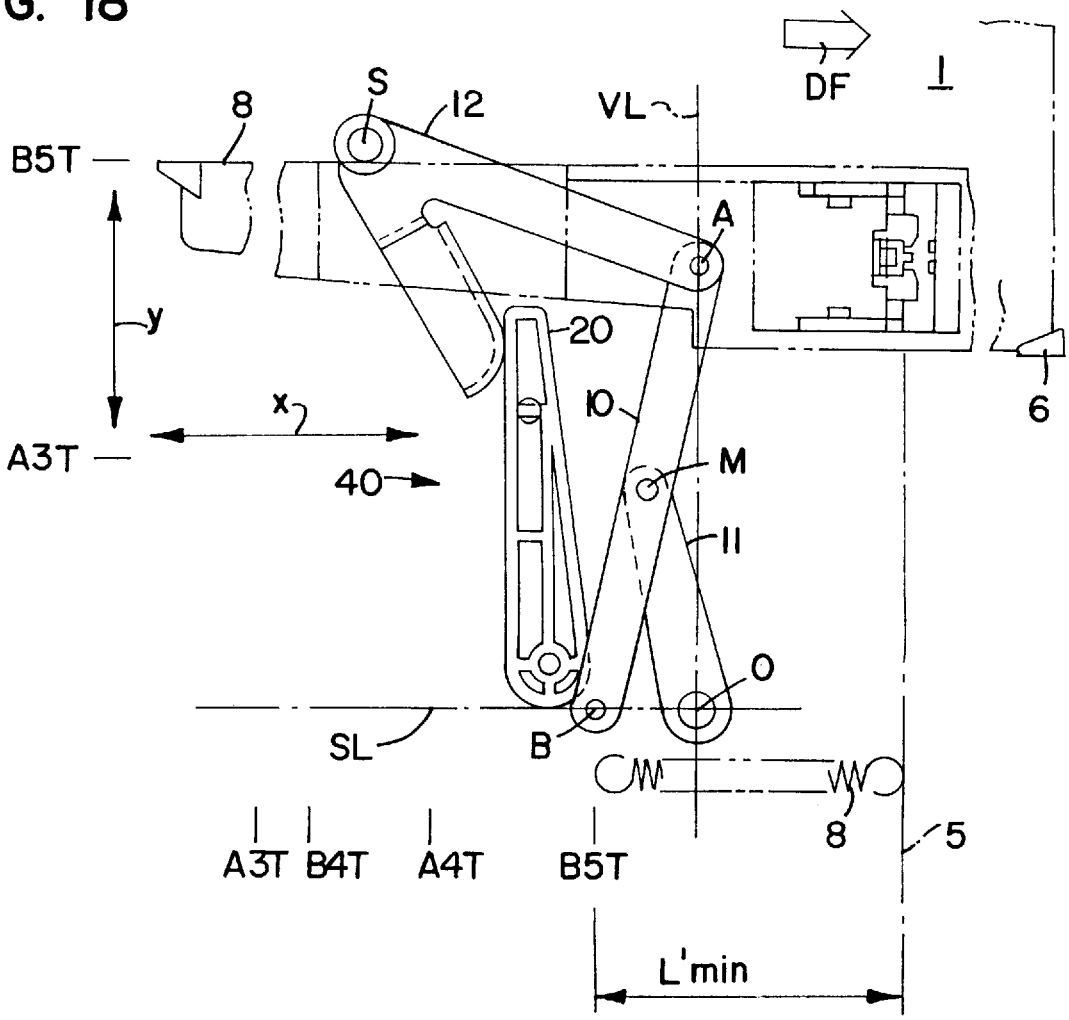
FIG. 18 is an enlarged top view of the link structure of the alternative embodiment for illustrating a released position of the spring according to the current invention.

Referring to FIG. 18, when the side fence 9 is placed to fit a B5 size image-carrying medium, even though the tray is at the inserted position, the multiple link arms 40 are designed not to expand the spring 8 of the predetermined characteristics in the second embodiment according to the current invention. The spring 8 remains at the Lmin length.

Figure 19:
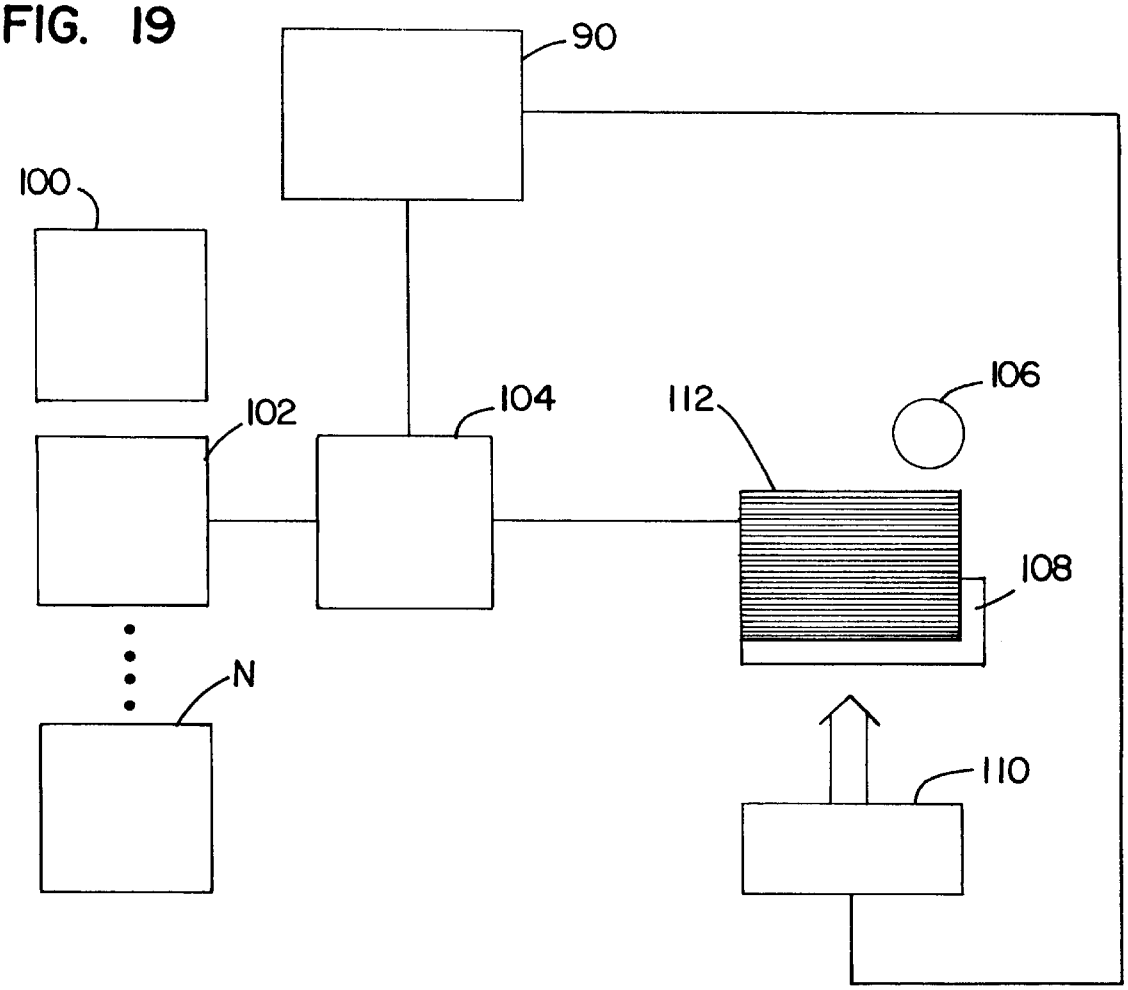
FIG. 19 is a block diagram illustrating a system for supplying an image-carrying medium of various sizes according to the current invention.

Lastly, referring to FIG. 19, a block diagram of a system for automatically loading a desired sized image-carrying medium and automatically indicating the size according to the current invention is provided. A plurality of storage units

100, 102 . . . N stores different sizes of image-carrying media. In response to a user selection, a controller 90 specifies a selected size to a transportation unit 104, and the transferring unit 104 moves a selected size pile to a feeding bed 108 located near a feeding roller 106. The controller also sends a signal indicative of the selected size to a side fence control unit 110 for moving a side fence to accommodate the selected size. In conjunction with this system, either the first embodiment or the second embodiment is used to control the expansion of the spring to provide an optimal initial pressure to lift the bed 108 towards a feeding roller 106.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts, within the principles of the invention to the full extent indicated by the broad general meaning of the terms in which the appended claims are expressed.

What is claimed is:

1. A method of lifting an image-carrying medium towards a predetermined location in an image-carrying medium supplying unit, the supplying unit removably placed in an image-generating device and having a movable guide for holding a predetermined capacity of the image-carrying medium and any size of the image-carrying medium within a predetermined range, comprising the steps of:

a) placing a stack of the image-carrying medium in the supplying unit;

b) moving the guide to fit a size of the image-carrying medium placed in the supplying unit, the size being continuously variable;

c) applying a desirable initial pressure on the image-carrying medium in proportion to the size indicated by the guide towards the predetermined location when the supplying unit is placed in the image generating device, the desirable initial pressure continuously decreasing to a predetermined final pressure as the stack is reduced until a last sheet of the image-carrying medium reaches the predetermined location; and d) automatically releasing the desirable pressure on the image-carrying medium for replenishing the stack of the image-carrying medium when the supplying, unit is removed from the image-generating device.

2. The method of lifting image-carrying medium according to claim 1 wherein the image-carrying media include at least paper and transparent plastic sheets.

3. The method of lifting image-carrying medium according to claim 1 wherein said range is a width of the image-carrying medium.

4. The method of lifting image-carrying medium according to claim 1 wherein said desirable initial pressure is applied by adding forces from a plurality of sources.

5. The method of lifting image-carrying medium according to claim 4 wherein said desirable pressure for the last sheet is substantially the same amount for any size of the image-carrying medium.

6. The method of lifting image-carrying medium according to claim 5 wherein said forces from some of said sources are variable.

7. The method of lifting image-carrying medium according to claim 5 wherein said forces from others of said sources are constant.

8. A method of lifting image-carrying media in an image-carrying medium supplying tray for an image-generating device, comprising the steps of:

a) applying a desirable pressure on a pile of the image-carrying medium placed in the image-carrying medium supplying tray based upon a size of the pile when the image-carrying medium supplying tray is placed in the image-generating device;

b) reducing the pile of the image-carrying medium;

c) continuously decreasing said pressure as the pile is reduced; and d) automatically releasing said pressure as the image-carrying medium supply tray is removed from the image-generating device while replenishing the stack of the image-carrying medium in the image-carrying medium supplying tray.

9. The method of lifting image-carrying media in an image-carrying medium supplying tray according to claim 8 wherein said pressure in said step a) is determined based upon a combination of the pile size and a image-carrying medium size.

10. The method of lifting image-carrying media in an image-carrying medium supplying tray according to claim 9 wherein said size has a predetermined range.

11. The method of lifting image-carrying media in an image-carrying medium supplying tray according to claim 10 wherein said range is a width.

12. An image-carrying medium supplying device removably located in an image-generating machine, comprising:

a movable image-carrying medium holding unit for holding a stack of an image-carrying medium;

a size indicator located on said movable image-carrying medium holding unit for indicating a size of the image-carrying medium held in said image-carrying medium holding unit, the size being continuously variable within a predetermined range, said size indicator further icluding a side fence slidable on said image-carring medium holding unit for guiding the sheets of the image-carrying medium, a position of said side fence with respect to said image-canying medium holding unit indicating the size; and an urging unit connected to said size indicator and said image-carrying medium holding unit for selectively urging said image-carrying medium holding unit in a predetermined direction with a desirable pressure in proportion to the indicated size as the image-carrying medium supplying device is placed in the image-generating machine, said urging unit further including a plurality of springs and a linkage unit for connecting at least one of said springs to said slidable fence so as to place said springs at an expanded position according to the size of the image-carrying medium.

13. The image-carrying medium supplying device according to claim 12 wherein said side fence slides along the width of the image carrying medium.

14. The image-carrying medium supplying device according to claim 12 wherein said springs each have a different strength.

15. The image-carrying medium supplying device according to claim 12 wherein said linkage unit performs an orthogonal conversion by converting a first movement of said side fence into a second movement orthogonal to said first movement.

16. The image-carrying medium supplying device according to claim 15 wherein said linkage unit further comprising a plurality of linkage bars.

17. The image-carrying medium supplying device according to claim 15 wherein said linkage unit further comprising a single linkage bar.

18. The image-carrying medium supplying device according to claim 15 wherein said linkage unit further comprising an activation linkage components for selectively activating the orthogonal conversion.

19. The image-carrying medium supplying device according to claim 12 wherein said springs continuously decreases a urging force to a predetermined final force for urging said image-carrying medium holding unit as said image-carrying medium holding unit is moved towards a predetermined empty position.

20. An universal image-carrying medium supplying tray, comprising:

a movable image-carrying medium holding unit for holding up to a predetermined maximum number of sheets of an image-carrying medium of various sizes;

a adjustable side fence located on said image-carrying medium holding unit for guiding the image-carrying medium held in said image-carrying medium holding unit, a position of said side fence determining a size of the image-carrying medium;

a link device having at least one link bar, one end of said link bar being connected to said adjustable side fence for conveying the position indicative of the size of the image-carrying medium; and a plurality of springs of a different strength, one end of at least one of said springs being connected to the other end of said link bar for being expanded to a length determined by the position of said link bar, the other end of said spring being connected to image-carrying medium holding unit so as to urge said image-carrying medium holding unit in a predetermined direction with a desirable initial pressure based upon in part the size of the image carrying medium.

21. The universal image-carrying medium supplying tray according to claim 20 further comprising an activation mechanism for selectively activating said link device.

22. The universal image-carrying medium supplying tray according to claim 20 wherein said movable image-carrying medium holding unit further comprises a bed for holding the image-carrying medium and a spring connecting plate connected to said bed at a predetermined angle for connecting said springs.

23. The universal image-carrying medium supplying tray according to claim 22 wherein said bed moves towards a predetermined location as a number of the sheets of the image-carrying medium held in said bed is decreased, said spring connecting plate correspondingly moving in a predetermined direction to decrease the desirable pressure.

24. The universal image-carrying medium supplying tray according to claim 20 wherein said link device converts a first movement of said side fence into a second movement orthogonal to said first movement.

25. A system for supplying an image-carrying medium to an image-generating machine which includes an image-synthesis engine for generating an image on an image-carrying medium and a feeding roller for feeding a sheet of the image-carrying medium towards the image-synthesis engine, comprising:

a tray housing unit detachably located in the image-generating machine near the feeding roller;

a movable holding unit located on said tray unit for holding a stack of the image-carrying medium of size within a predetermined range, said holding unit being movable towards the feeding roller;

a size indicator located on said movable holding unit for indicating a size of the image-carrying medium held in said holding unit, the size being continuously variable within the predetermined range;

an adjustable urging unit connected to said size indicator and said holding unit for urging said holding unit towards the feeding roller with a desirable initial pressure in proportion to the indicated size, said urging unit adjustably decreasing the initial pressure to a predetermined final pressure as said feeder reduces the stack on said holding unit; and an urging control unit for selectively activating the desirable initial pressure as said tray housing unit is placed in said image-generating machine and for releasing the pressure as said tray is detached from said image-generating machine.

26. The system for supplying an image-carrying medium according to claim 25 wherein said control unit includes a latch for latching said tray in said image-generating machine.

27. The system for supplying an image-carrying medium according to claim 25 wherein said size indicator is a slidable side fence located on said holding unit, a position of said side fence with respect to said holding unit indicating the size of the image-carrying medium.

28. The system for supplying an image-carrying medium according to claim 27 wherein said urging unit further comprises a spring and a link arm for mechanically connecting said side fence with said spring.

29. The system for supplying an image-carrying medium according to claim 28 wherein said size indicator further includes a link arm path guide for restricting an extent of movement of said link arm, said side fence being integrally connected to said link path guide for sliding together to change the position, said link arm thus expanding said spring to an amount determined by said side fence.

30. The system for supplying an image-carrying medium according to claim 29 wherein said link arm includes a first cam located at one end of said link arm, said first cam turning in a first direction around a distal end of said link arm path guide so as to lock said link arm in a position as said spring is expanded to the amount determined by said side fence when said tray unit is placed in the image generating machine.

31. The system for supplying an image-carrying medium according to claim 30 wherein said first cam turns in a second direction around said distal end of said link arm path guide to unlock said link arm from the locked position as said spring is released from the expanded amount when said tray unit is taken out of the image generating machine.

32. The system for supplying an image-carrying medium according to claim 30 wherein said link arm includes a second cam located below said first cam and at said one end of said link arm, said second cam being disposed at a predetermined angle with said first cam, said second cam being urged by a stationary post located on the image-generating machine as the tray is inserted.

33. A system for generating an image on an image-carrying medium, comprising:

an image-generating machine having an image-synthesis engine and a feeding roller for feeding a sheet of an image-carrying medium towards the image-synthesis engine;

an image-carrying medium supplying unit detachably located near said feeding roller for feeding a stack of the image-carrying medium at a feeding position, said image-carrying medium supplying unit being adjustable to hold various sizes of the image-carrying medium;

a pressure applying unit located near said image-carrying medium supplying unit for applying a desirable pressure to the stack of the image-carrying medium towards said feeding roller; and a control unit connected to said pressure applying unit having a linkage, said linkage selectively activating the desirable pressure in proportion to a size and an amount of the image-carrying medium held in said image-carrying medium supplying unit when said image-carrying medium supplying unit is placed at the feeding position said, linkage automatically deactivating the desirable pressure when said image-carrying medium supplying unit is removed from the feeding position.

34. The system for supplying an image-carrying medium according to claim 33 wherein said control unit continuously adjusts the desirable pressure as the amount of the image-carrying medium changes.

35. The system for supplying an image-carrying medium according to claim 33 wherein said pressure applying unit includes a plurality of springs.

36. The system for supplying an image-carrying medium according to claim 35 wherein said control unit includes a link arm to variably expand one of said springs to a length based upon the size.

* * * * *